US009351554B2

(12) United States Patent
Sener et al.

(10) Patent No.: US 9,351,554 B2
(45) Date of Patent: May 31, 2016

(54) HANDLE FOR LUGGAGE

(71) Applicant: Travelpro International, Inc., Boca Raton, FL (US)

(72) Inventors: James T. Sener, Glastonbury, CT (US); Christopher D. Hageman, South Glastonbury, CT (US); David L. Mathieu, Colchester, CT (US); Scott Smith, Hartford, CT (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 14/734,314

(22) Filed: Jun. 9, 2015

(65) Prior Publication Data

US 2015/0272291 A1 Oct. 1, 2015

Related U.S. Application Data

(63) Continuation of application No. 14/484,669, filed on Sep. 12, 2014, which is a continuation of application No. 13/871,488, filed on Apr. 26, 2013, now Pat. No. 8,851,251, which is a continuation of application No. PCT/US2011/057207, filed on Oct. 21, 2011.

(60) Provisional application No. 61/407,971, filed on Oct. 29, 2010.

(51) Int. Cl.

| | |
|---|---|
| ***A45C 5/14*** | (2006.01) |
| ***A45C 13/26*** | (2006.01) |
| *A45C 13/28* | (2006.01) |

(52) U.S. Cl.

CPC ..... *A45C 13/262* (2013.01); *A45C 5/14* (2013.01); *A45C 13/26* (2013.01); *A45C 5/145* (2013.01); *A45C 13/28* (2013.01); *A45C 2013/265* (2013.01); *A45C 2013/267* (2013.01); *Y10T 16/451* (2015.01); *Y10T 16/4576* (2015.01)

(58) Field of Classification Search

CPC ..... A45C 5/14; A45C 2013/262; A45C 2013/267; Y10T 16/451; Y10T 16/4554

USPC ..... 190/18 A, 39, 115

See application file for complete search history.

(56) References Cited

U.S. PATENT DOCUMENTS 3,522,955 A * 8/1970 Warner, Jr. ..... 280/655.1
3,813,729 A 6/1974 Szabo et al.

(Continued)

FOREIGN PATENT DOCUMENTS

CN 2340253 Y 9/1999
CN 2440362 Y 8/2001

(Continued)

OTHER PUBLICATIONS

Great Britain Examination Report, Application No. GB1309378.6, Applicant: Travelpro International Inc., Date of Report: Apr. 9, 2015, 5 pages.

(Continued)

*Primary Examiner* — Sue A Weaver

(74) *Attorney, Agent, or Firm* — Reising Ethington P.C.

(57) ABSTRACT

An ergonomic handle for luggage is provided. In one aspect, the handle comprises at least one palm grip. The handle is attached to a compartment with wheels. The palm grip can be used to push the luggage as the wheels roll over a rolling surface.

29 Claims, 36 Drawing Sheets

(56) References Cited

U.S. PATENT DOCUMENTS

| | | | | |
|---|---|---|---|---|
| 4,118,048 | A | 10/1978 | Spranger et al. | |
| 4,561,526 | A | 12/1985 | Winter et al. | |
| 4,989,511 | A | 2/1991 | Clarke, Jr. | |
| 5,377,795 | A | 1/1995 | Berman | |
| 5,400,494 | A * | 3/1995 | Stilley | 29/434 |
| 5,452,778 | A | 9/1995 | Wang | |
| 5,630,250 | A | 5/1997 | Chou | |
| 5,669,103 | A | 9/1997 | Hui | |
| 5,762,168 | A | 6/1998 | Miyoshi | |
| 5,782,325 | A | 7/1998 | O'Shea et al. | |
| 5,890,570 | A | 4/1999 | Sadow | |
| 5,914,425 | A | 6/1999 | Meisel et al. | |
| 5,934,425 | A * | 8/1999 | Sadow | 190/115 |
| 5,964,451 | A | 10/1999 | Sudheimer | |
| 5,992,588 | A * | 11/1999 | Morszeck | 190/18 A |
| 6,065,574 | A | 5/2000 | Miyoshi | |
| 6,193,033 | B1 | 2/2001 | Sadow et al. | |
| 6,301,746 | B1 | 10/2001 | Myers et al. | |
| 6,434,790 | B1 | 8/2002 | Chen | |
| 6,450,308 | B1 * | 9/2002 | Kuo | 190/115 |
| 6,484,362 | B1 * | 11/2002 | Kuo | 16/113.1 |
| 6,533,086 | B1 * | 3/2003 | Waddell et al. | 190/18 A |
| 6,564,426 | B1 * | 5/2003 | Wang | 16/113.1 |
| 6,920,666 | B1 * | 7/2005 | Chen | 16/113.1 |
| 7,188,715 | B1 | 3/2007 | Chen | |
| 7,438,308 | B2 | 10/2008 | Kim et al. | |
| 7,461,730 | B2 | 12/2008 | Costa et al. | |
| 7,467,696 | B2 | 12/2008 | Wu | |
| D591,511 | S | 5/2009 | Wu | |
| D637,398 | S | 5/2011 | Jiang | |
| D648,132 | S | 11/2011 | Wu | |
| D651,803 | S | 1/2012 | Wu | |
| D696,019 | S | 12/2013 | Sener et al. | |
| 8,851,251 | B2 | 10/2014 | Sener et al. | |
| 2002/0014382 | A1 | 2/2002 | Kuo | |
| 2002/0024189 | A1 | 2/2002 | Chen | |
| 2003/0079950 | A1 | 5/2003 | Lin et al. | |
| 2003/0102195 | A1 * | 6/2003 | Mittleman et al. | 190/115 |
| 2003/0132080 | A1 * | 7/2003 | Dababneh | 190/115 |
| 2005/0173876 | A1 * | 8/2005 | Sadow | 280/37 |
| 2005/0258621 | A1 | 11/2005 | Johnson et al. | |
| 2005/0279123 | A1 * | 12/2005 | Maldonado et al. | 62/457.7 |
| 2005/0279600 | A1 * | 12/2005 | Goldwitz | 190/115 |
| 2006/0006037 | A1 * | 1/2006 | Hsieh | 190/115 |
| 2006/0027985 | A1 | 2/2006 | Miyoshi | |
| 2006/0031994 | A1 | 2/2006 | Willat et al. | |
| 2006/0272126 | A1 * | 12/2006 | Burgess et al. | 16/113.1 |
| 2007/0158159 | A1 | 7/2007 | Burgess | |
| 2007/0266527 | A1 | 11/2007 | Chen | |
| 2008/0083592 | A1 | 4/2008 | Mangano | |
| 2008/0179153 | A1 * | 7/2008 | Wu | 190/115 |
| 2008/0308370 | A1 | 12/2008 | Chung et al. | |
| 2009/0139814 | A1 | 6/2009 | Grossman et al. | |
| 2009/0218187 | A1 * | 9/2009 | Chung et al. | 190/18 A |
| 2010/0293755 | A1 * | 11/2010 | Draper et al. | 16/430 |
| 2011/0079479 | A1 * | 4/2011 | Yang | 190/18 A |
| 2011/0088987 | A1 | 4/2011 | Santy et al. | |
| 2011/0168507 | A1 | 7/2011 | Penley et al. | |

FOREIGN PATENT DOCUMENTS

| | | | |
|---|---|---|---|
| CN | 1622773 | A | 6/2005 |
| CN | 2825016 | Y | 10/2006 |
| CN | 2894387 | Y | 5/2007 |
| CN | 201451800 | U | 5/2010 |
| DE | 3636064 | A1 | 4/1988 |
| DE | 102005002898 | A1 | 10/2005 |
| GB | 2 318 973 | A | 5/1998 |
| WO | WO 03/063637 | A2 | 8/2003 |
| WO | 2008098116 | A1 | 8/2008 |
| WO | WO 2009/029244 | A1 | 3/2009 |

OTHER PUBLICATIONS

Comfort Grip Luggage Handle Extender, http://www.flightattendantshop.com/product/detail,cfm/nid/6/pid/267, Oct. 14, 2010, 1 page.

Thumb Pad on a Cup, http://www.promotional-gifts-inc.com/custom-wholesale/Drinkware-Mugs/Spnuzzo-150z-Plastic-Mug-with-Steel-Interior-Handle-6253.htm, Oct. 14, 2010, 1 page.

Werks Traveler 20* Deluxe Wheeled Travel Bag, http://www.wellpromo.com/upload/upimg60/Werks-Traveler-20-Deluxe Whee-151660.jpg, Oct. 14, 2010, 1 page.

Evaluation Report of Utility Model Patent, State Intellectual Property Office of the People's Republic of China, Mailing Date—May 30, 2013, 7 pages.

International Search Report and Written Opinion, International Application No. PCT/US2011/057207, Filed: Oct. 21, 2011, Mailing Date: Mar. 20, 2012, 11 pages.

Email dated Thursday, Jul. 9, 2015, 11:46 AM, Subject: TravelPro v. Ricardo Rule 408 Correspondence, (individual names/email addresses redacted), 1 page.

Defendant's Answer, Defenses, Affirmative Defenses and Counterclaims to Plaintiff's Complaint for Patent Infringement, United States District Court, Southern District of Florida, Case No. 15-80340-CIV-Middlebrooks/Brannon, *Travelpro International, Inc.* (Plaintiff) vs *Ricardo Beverly Hills, Inc.* (Defendant) vs. *Ricardo Beverly Hills, Inc.* (Counter-Plaintiff) vs. *Travelpro International, Inc.* (Counter-Defendant), 8 pages.

United Kingdom Examination Report under Section 18(3), Application No. GB1309378.6, Applicant: Travelpro International Inc., Report Date: Aug. 10, 2015, 4 pages.

United Kingdom Examination Report Under Section 18(3), Application No. GB1309378.6, dated Nov. 6, 2015, Applicant: Travelpro International, Inc., 4 pages.

* cited by examiner

HANDLE FOR LUGGAGE

CROSS REFERENCE TO RELATED APPLICATION DATA

The present invention claims priority from U.S. Provisional Patent Application No. 61/407,971, filed Oct. 29, 2010.

FIELD

The present specification relates generally to luggage and more specifically relates to handles for luggage.

BACKGROUND

Travel is a common human activity and luggage is an important feature of travel. When it comes to air travel, the demands on luggage can be particularly intense.

BRIEF DESCRIPTION OF THE DRAWINGS

Reference will now be made, by way of example only, to the accompanying drawings in which.

DETAILED DESCRIPTION

As used herein, any usage of terms that suggest an absolute orientation (e.g. "top", "bottom", "front", "back", etc.) are for illustrative convenience and refer to the orientation shown in a particular figure. However, such terms are not to be construed in a limiting sense as it is contemplated that various components may in practice be utilized in orientations that are the same as, or different than those, described or shown.

Figure 1:
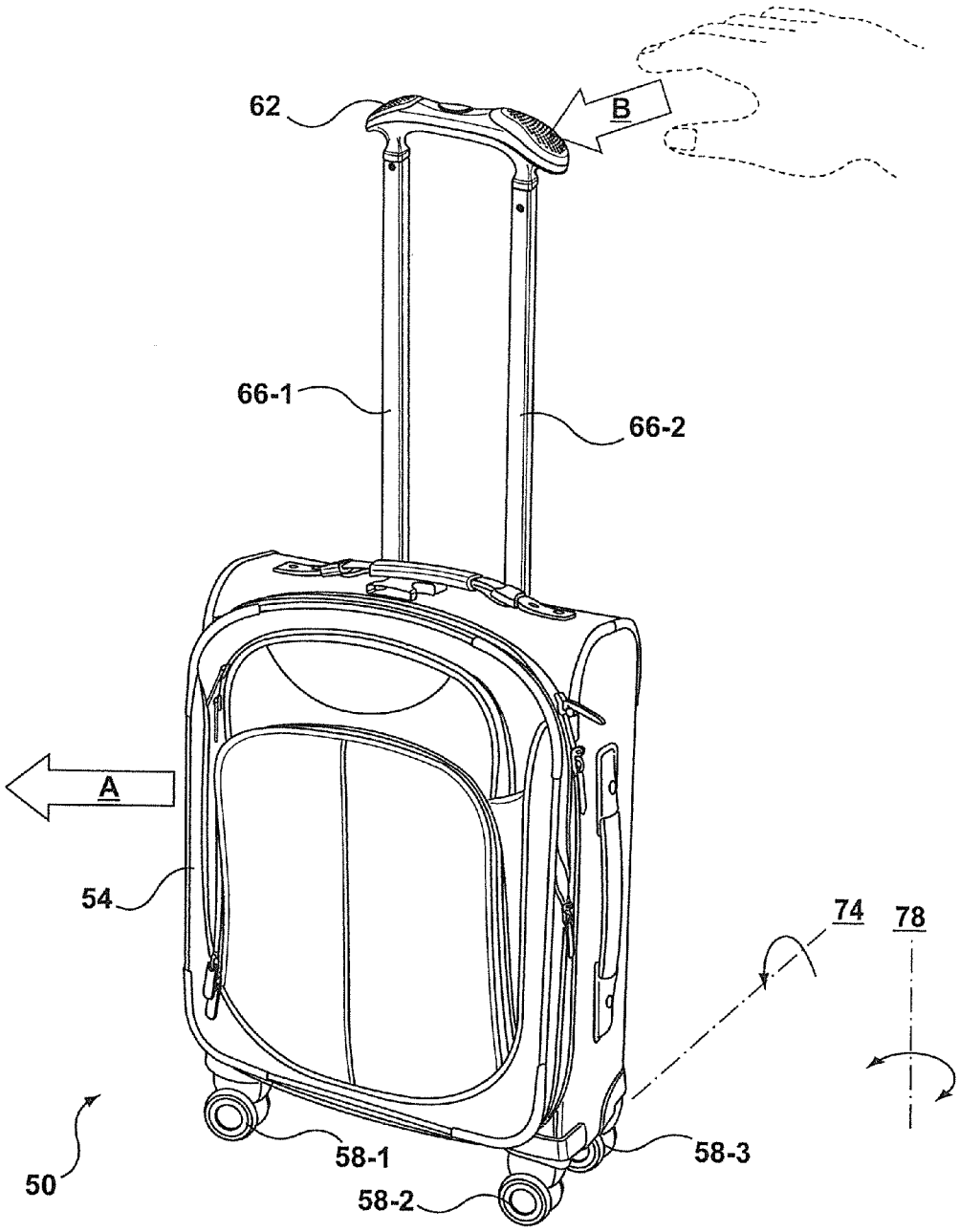
FIG. 1 is a perspective view of an article of luggage being pushed in a first direction.
Figure 2:
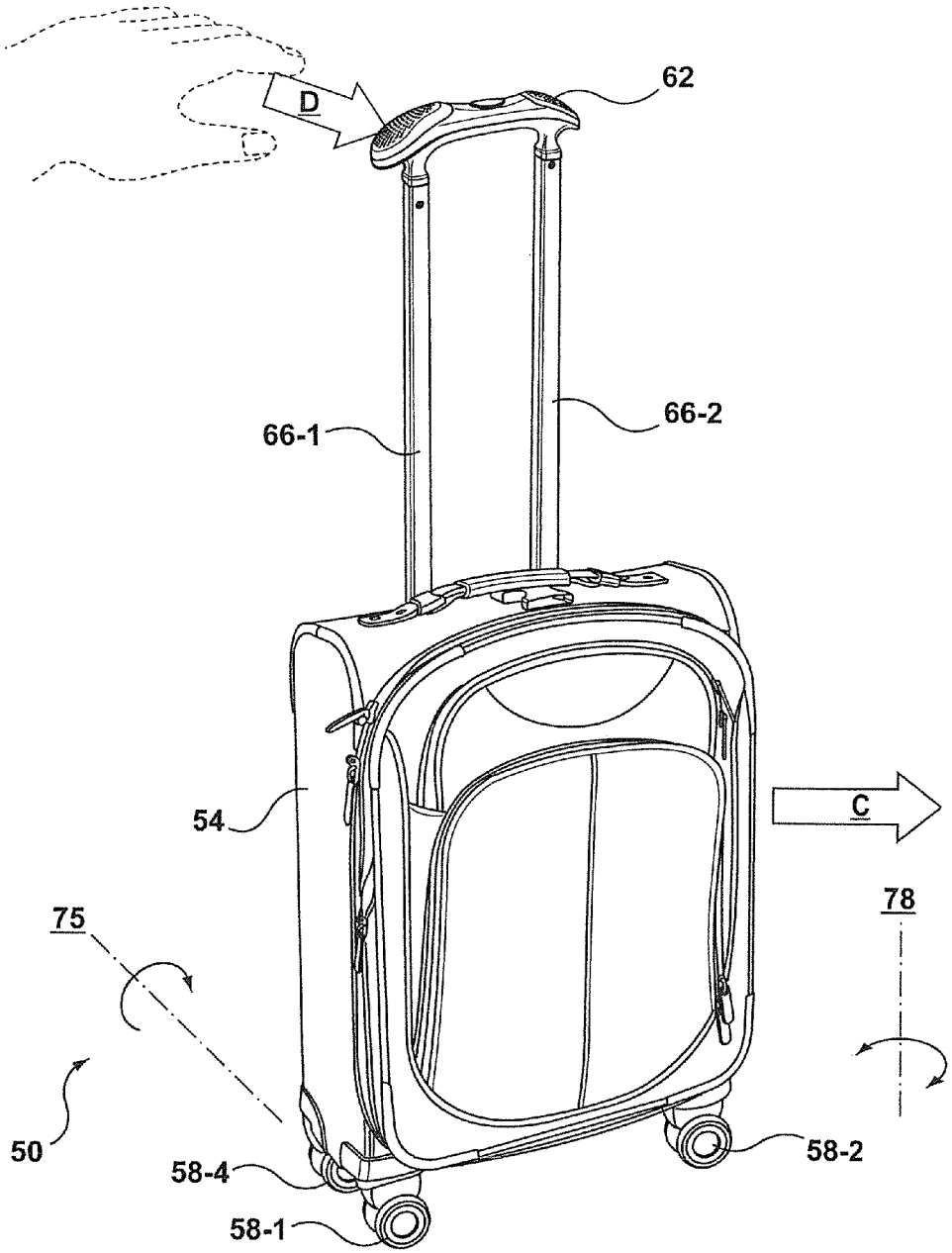
FIG. 2 shows the article of luggage from FIG. 1 being pushed in the opposite direction shown in FIG. 1.

Referring now to FIG. 1 and FIG. 2, an article of luggage is indicated generally at 50. In a non-limiting example embodiment, luggage 50 comprises a compartment 54 for storing and transporting personal effects or other articles. Luggage 50 also comprises a plurality of wheels plurality of wheels 58-1, 58-2, 58-3 and 58-4. (Collectively, wheels 58, and generically, wheel 58. This nomenclature is used elsewhere herein.) Wheels 58 are mounted to compartment 54, and can be used to roll luggage 50 along a substantially smooth surface.

Figure 3:
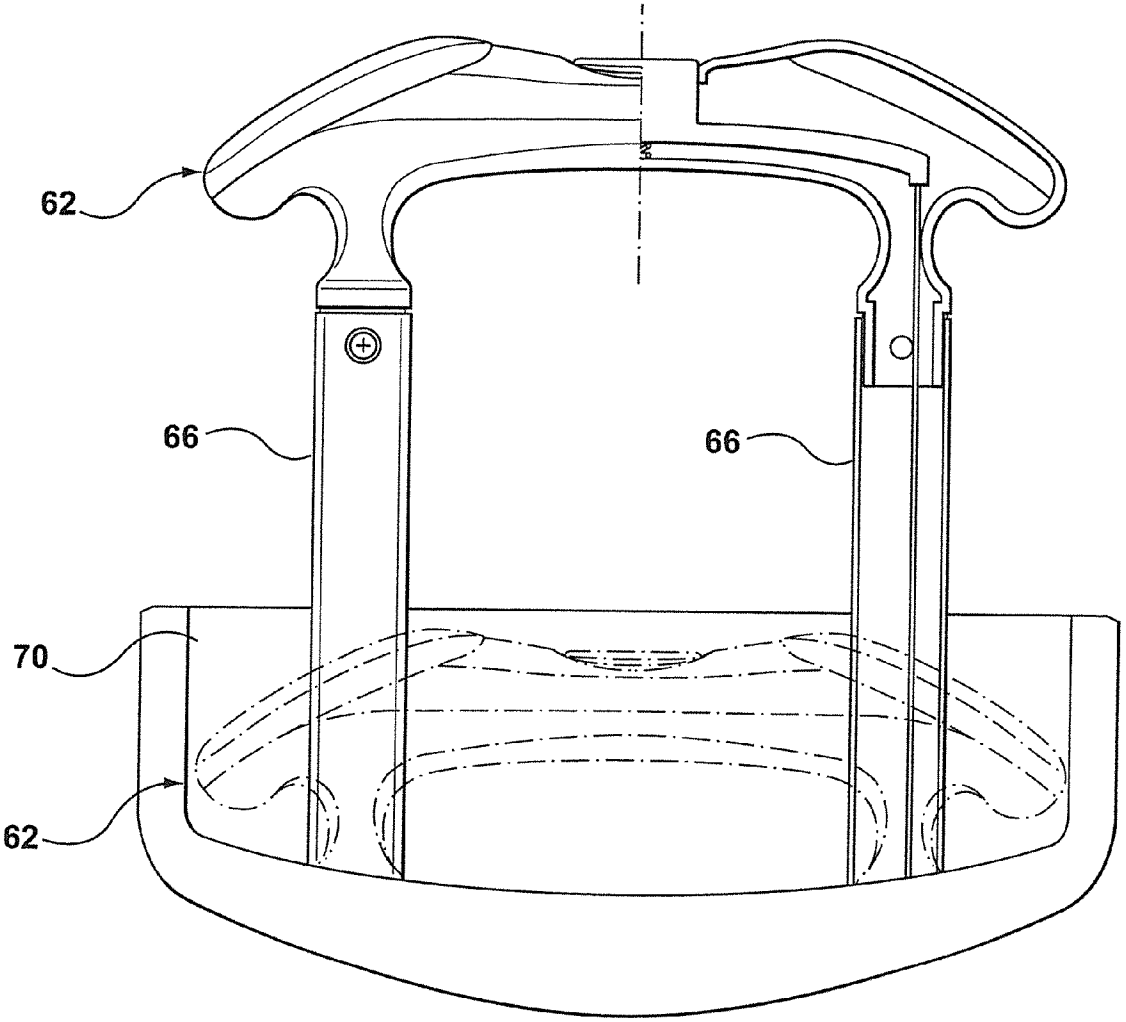
FIG. 3 is shows the handle and rods of the luggage of FIG. 1 and FIG. 2 in an extended and retracted position.
Figure 4:
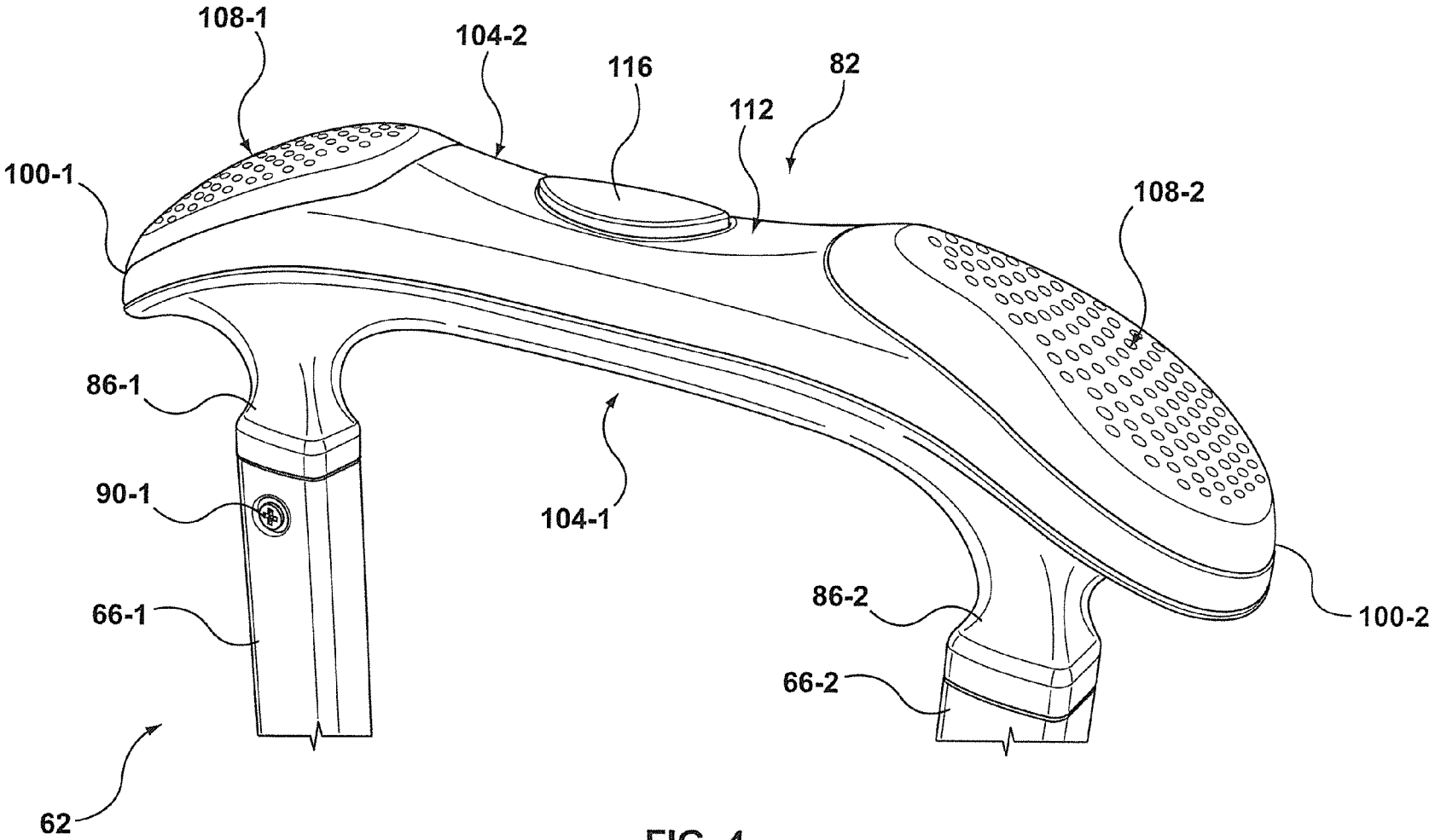
FIG. 4 shows a perspective view of the handle of FIG. 1.

Luggage 50 also comprises a handle 62 that connects to compartment 54 via a pair of retractable rods 66. In FIG. 1 and FIG. 2, rods 66 are in a fully extended position so that handle 62 is brought within an arm's reach while a person is standing substantially upright. As seen in FIG. 3, rods 66 are movable between the extended position in FIG. 1 and FIG. 2 to a retracted position within a recessed chamber 70 disposed within a side of compartment 54 that is opposite from the side of compartment 54 to which wheels 58 are mounted.

Referring again to FIG. 1 and FIG. 2, in a present embodiment, compartment 54 which can be opened to receive or remove articles, and can be closed for storage or transportation. It is to be understood that the nature of compartment 54 is not particularly limited, and that variations on the configuration of the compartment 54 shown in Figure are contemplated. For example, compartment 54 can be of a hard material (e.g. plastic or metal) or a soft material (e.g. fabric). Compartment 54 can also have different configurations, including a split configuration comprising two equal size halves or non-equal size halves. Compartment 54 can be a backpack, dufflebag, or briefcase. Compartment 54 can also be configured to open from one or more different sides, and the means by which it is opened is not particularly limited. Likewise the configuration, orientation and type of hinging mechanism are not particularly limited. A variety of other types of compartments will now occur to those skilled in the art.

In a present embodiment, four wheels 58 are provided. As seen in FIG. 1 each wheel can rotate along a rotational axis 74 that is substantially parallel to a rolling surface so that luggage 50 can be rolled in direction "A" in reaction to a force applied along direction "B" to handle 62. Wheels 58 are also configured to spin along an axis 78 that is perpendicular to the rolling surface, to thereby change the orientation of rotational axis 74 so that luggage 50 can be rolled in any direction along rolling surface. To illustrate this point, in FIG. 2 luggage 50 is shown as being moved in direction "C" (opposite to direction "A" in FIG. 1) in reaction to force applied along direction "D" to the opposite side of handle 62, such that wheels 58 rotate along rotational axis 75. It is to be understood that the number and nature of wheels 58 is also not particularly limited. For example, fewer or more wheels can be provided. In other configurations, one or more of the wheels may be configured to spin, or not, along axis 78.

Figure 8:
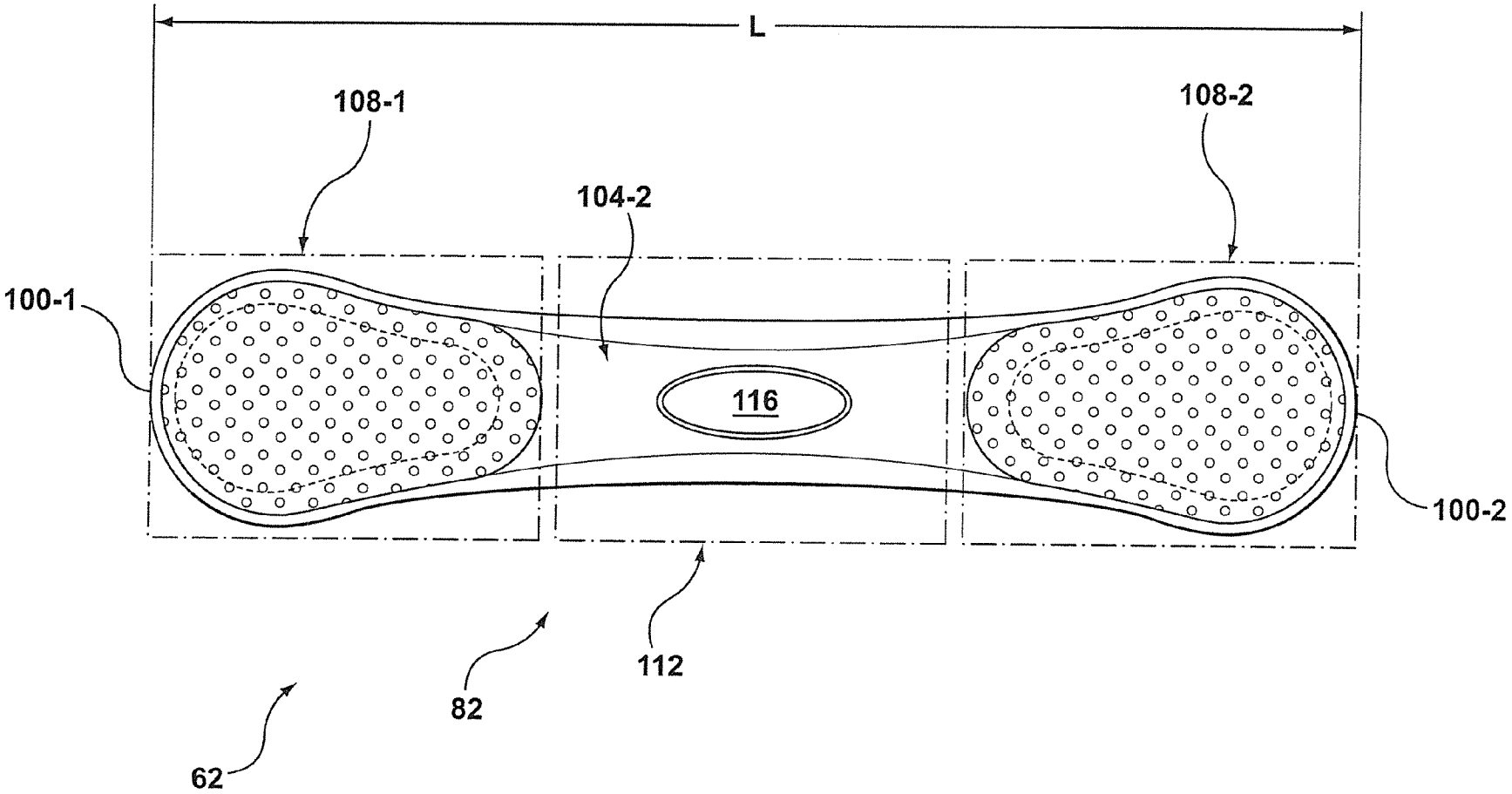
FIG. 8 shows a top planar view of the handle of FIG. 1.
Figure 9:
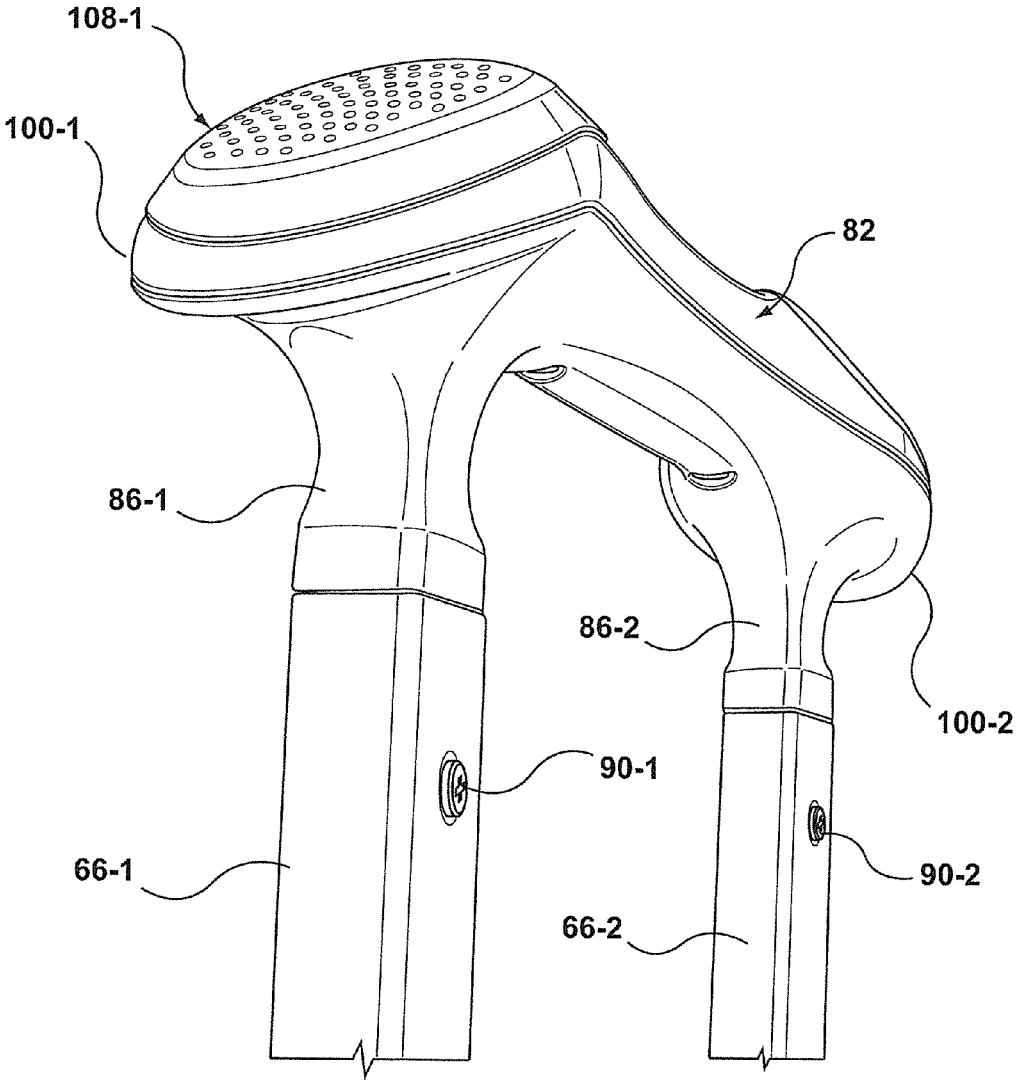
FIG. 9 shows a bottom-left perspective view of the handle of FIG. 1.
Figure 10:
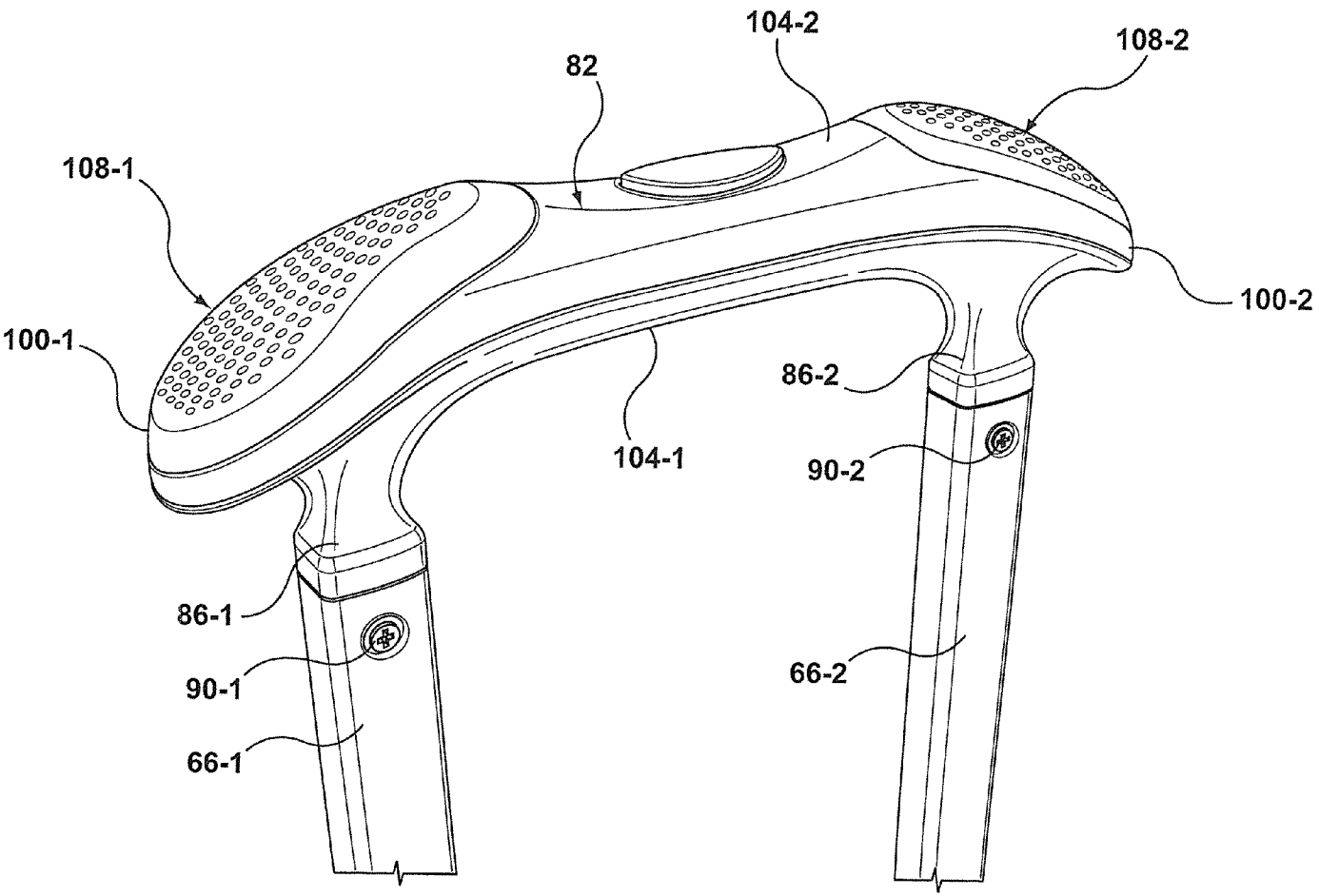
FIG. 10 shows a top-left perspective view of the handle of FIG. 1.
Figure 11:
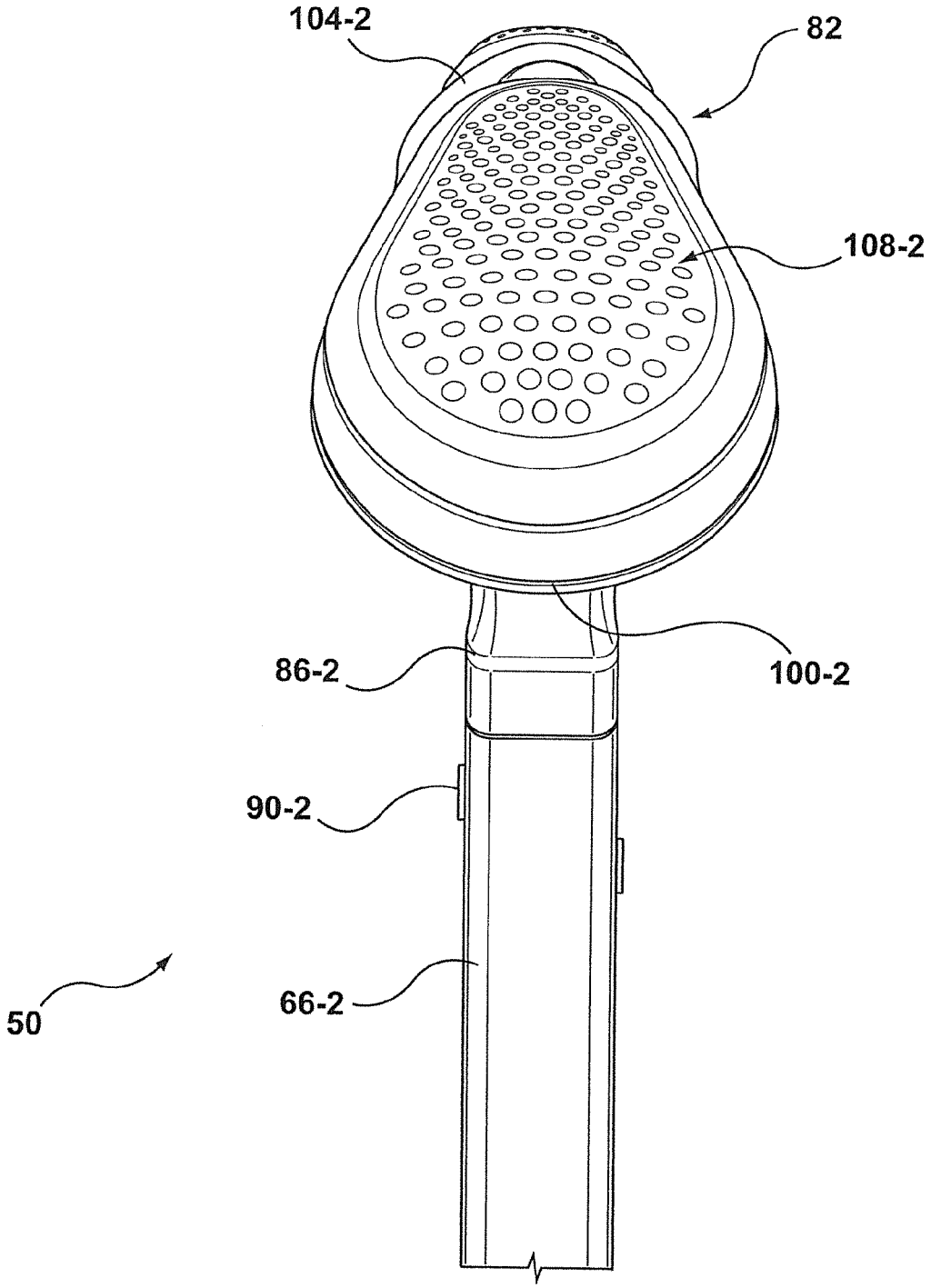
FIG. 11 shows a right view of the handle of FIG. 1.
Figure 12:
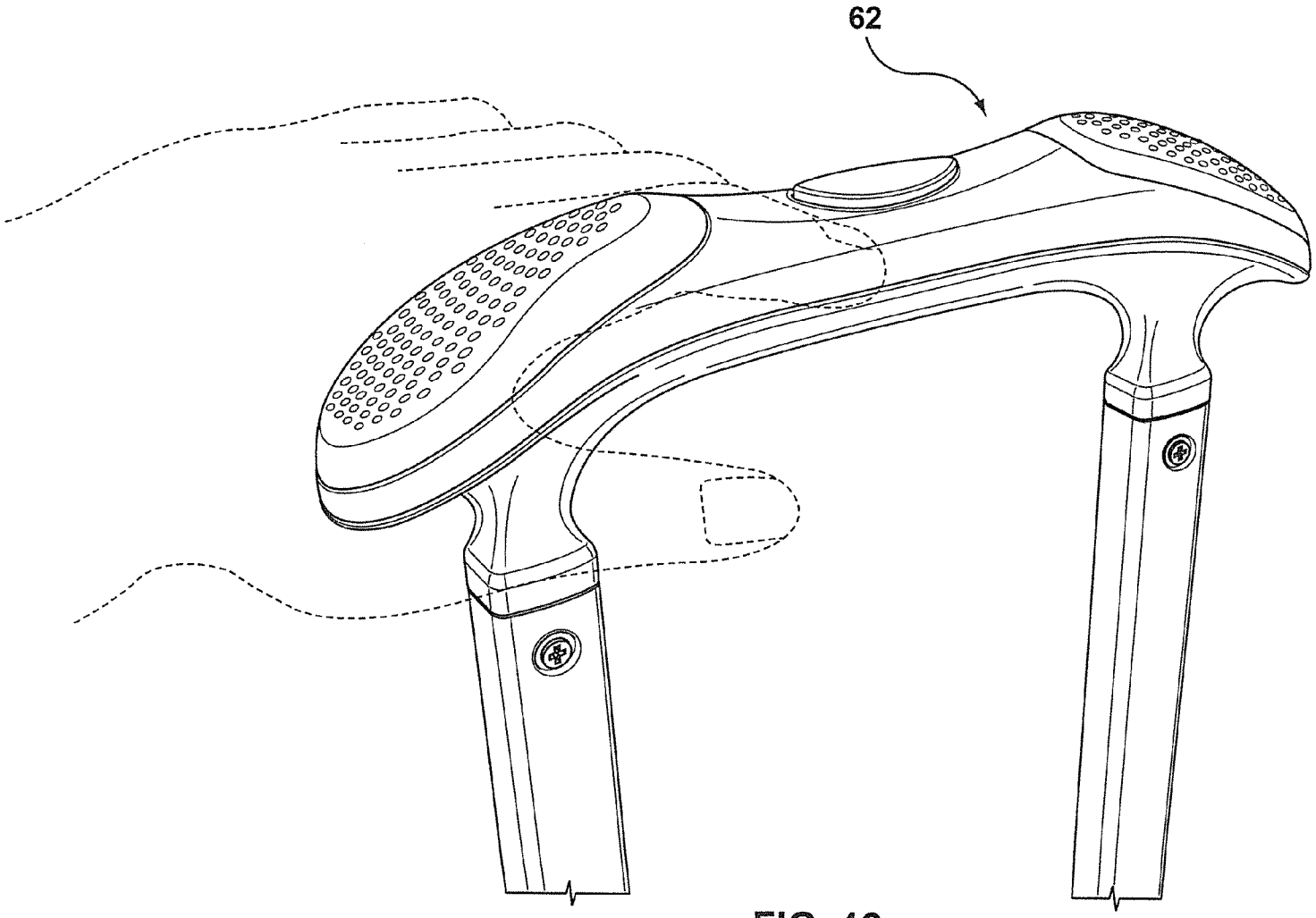
FIG. 12 shows the same view as FIG. 10 but with an outline of a human hand engaging with the handle.

Referring now to FIGS. 4-11, handle 62 is shown in greater detail. Handle 62 thus comprises a body 82. Body 82 has a first end 100-1 opposite to a second end 100-2 and a proximal edge 104-1 and opposite to a distal edge 104-2. As best seen in FIG. 8, edges 104 define a length L of body 82 between each end 100.

Proximal edge 104-1 includes a pair of rod-junctions 86. In a present embodiment, each rod-junction 86 is implemented as a strut received within a hollow end of a distal end of a respective rod 66 and mechanically fastened thereto by a screw 90. Other configurations for attaching body 82 to rods 66 are contemplated.

Distal edge 104-2 includes a pair of palm grips 108. First palm grip 108-1 is situated at first end 100-1, and second palm grip 108-2 is situated at second end 100-2. A central grip 112 is disposed between each palm-grip 108. While palms grips 108 and central grip 112 are labeled in various Figures, FIG. 8 uses hashed-boxes to more specifically illustrate which portions of body 82 correspond to palms grips 108 and central grip 112. From the view in FIG. 5, it can be seen that palm grips 108 are substantially convex while central grip 112 is substantially concave.

Each palm grip 108 has a shape that complements the palm (or metacarpus) of a human hand, in order to distribute a force across a corresponding area of the palm. In a present embodiment, each palm grip 108 is rounded to further distribute force across the palm. Each palm grip 108 is also substantially tear-drop shaped having wider bulbous portion proximal to its respective end 100 and a narrow bulbous portion proximal central grip 112. While body 82 is made from a substantially non-deformable material, such as a hard plastic, each palm grip 108 is made from a resiliently-deformable material, such as a foamed plastic, which is affixed to body 82 via a glue or other fastening means. The deformable nature of each palm grip 108 further improves the distribution of force across the area of the palm (or other entity that applies the force) that comes into contact with the palm grip 108.

In a present embodiment the surface of each palm grip 108 is dimpled to increase the level of friction between the palm and the surface of the palm grip 108, and reduce the likelihood of the palm slipping from the palm grip 108 while luggage 50 is being pushed. Other texture patterns, other than dimpling, are contemplated.

Figure 5:
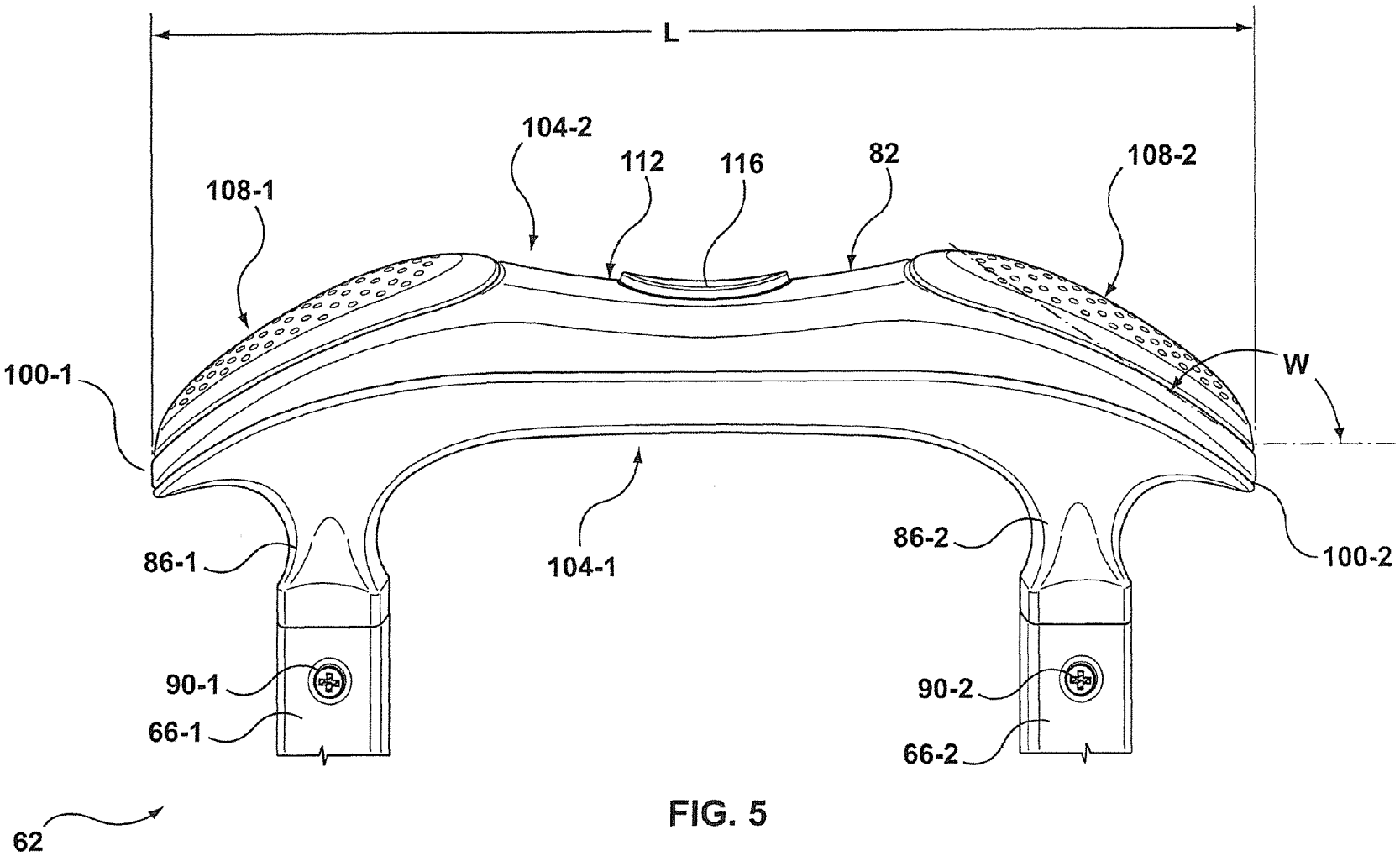
FIG. 5 shows a front planar view of the handle of FIG. 1.
Figure 6:
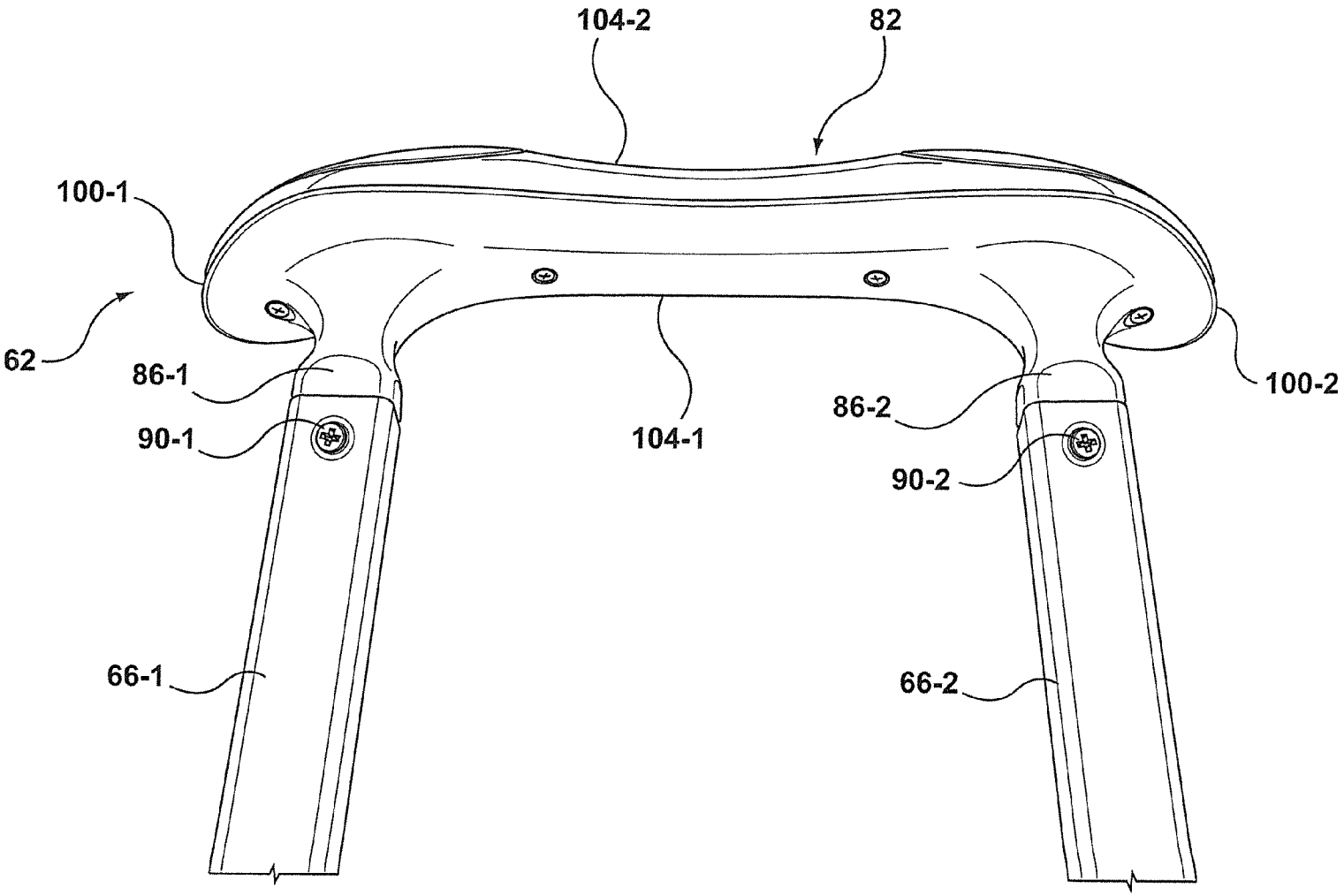
FIG. 6 shows a bottom perspective view of the handle of FIG. 1.
Figure 7:
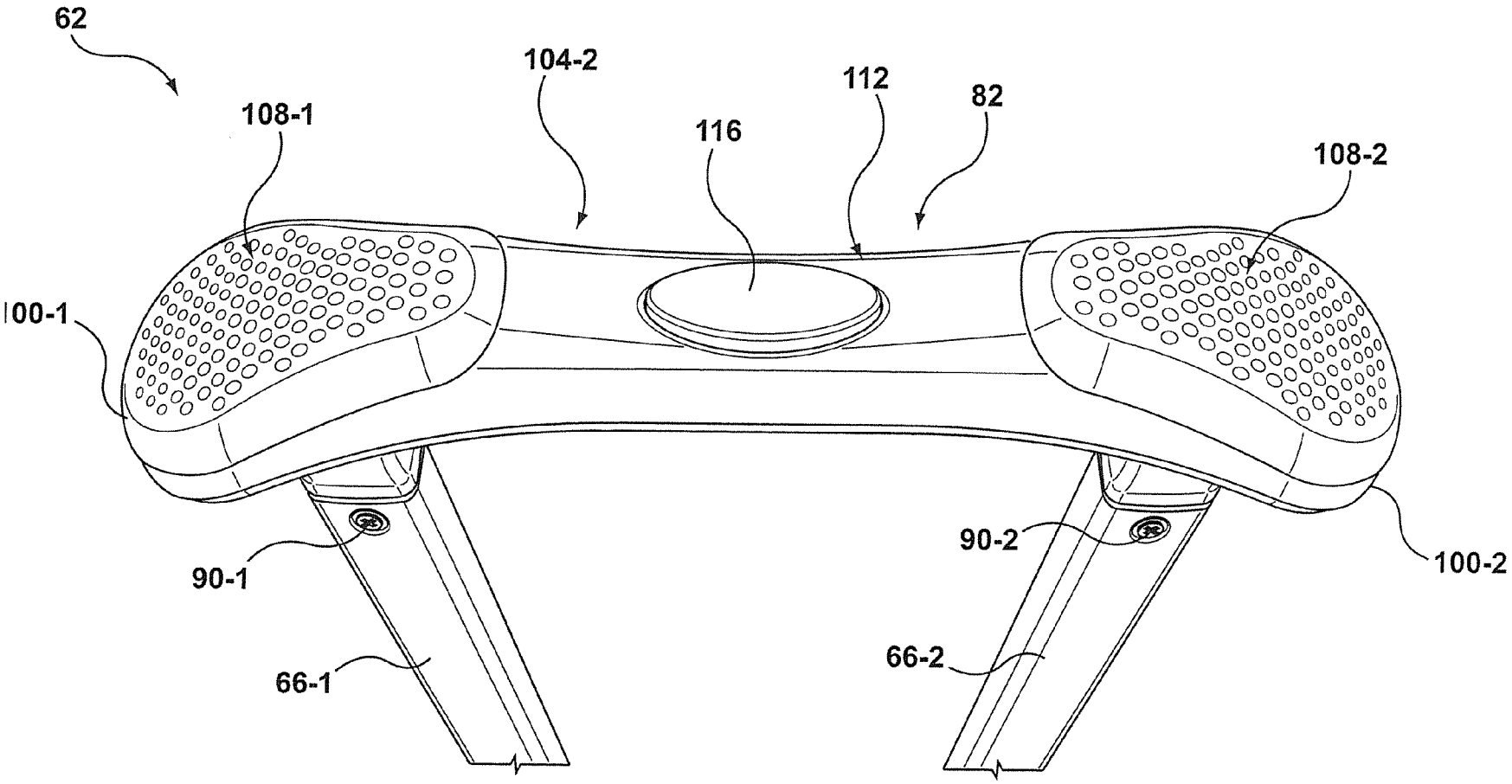
FIG. 7 shows a top perspective view of the handle of FIG. 1.

As best seen in FIG. 5, each palm grip 108 is also angled. In FIG. 5, an angle w is shown in relation to palm grip 108-2. Angle w defines an obtuse angle measured from a plane parallel to the length L of body 82. The actual length L is not particularly limited, and can be selected to accommodate various sizes of hands according to the teachings herein.

Angle w is chosen to complement a position for pushing luggage 50 that is well within a natural range of motion of the human wrist, so that the palm of the human hand can engage with a palm grip 108 without requiring an uncomfortable or otherwise unnatural bend in the human wrist. Angle w is thus greater than about ninety degrees but less than one-hundred-and-eighty-degrees. Angle w is presently preferred to be between about one-hundred-fifty-degrees and about one-hundred-and-ten-degrees. More specifically, angle w is presently preferred to be between about one-hundred-forty-five degrees and about one-hundred-and-twenty-degrees. More specifically, angle w is presently preferred to be between about one-hundred-forty-degrees and about one-hundred-and-thirty-degrees. More specifically, angle w is presently preferred to be about one-hundred-and-thirty-five-degrees.

As viewed in FIG. 8, central grip 112 is slightly convex along its outer edges, being slightly wider at its outer edges where central grip 112 joins with each palm grip 108. It should be understood, however, that central grip 112 can have different shapes, including having substantially the same width along its entire length. As viewed in FIG. 5, central grip is slightly concave along distal edge 104-2. An actuator 116 is disposed in the middle of central grip 112. Actuator 116 is biased towards a distal position which locks rods 66 in the extended position shown in FIG. 1 and FIG. 2. Actuator 116 may be depressed towards a position that is substantially contiguous with the surface of central grip 112, which unlocks rods 66 so that rods may be moved between the extended position and the retracted position shown in FIG. 3. Mechanical means are typically provided so that, upon release, actuator 116 is urged to the distal position and locks rods 66 in the retracted position shown in FIG. 3. Further mechanical means may also be provided so that handle 62 can be positioned, and locked, at one or more intermediate positions between the extended position shown in FIG. 1 and FIG. 2. It is presently preferred to provide at least one such intermediate position, to be discussed further below.

Figure 13:
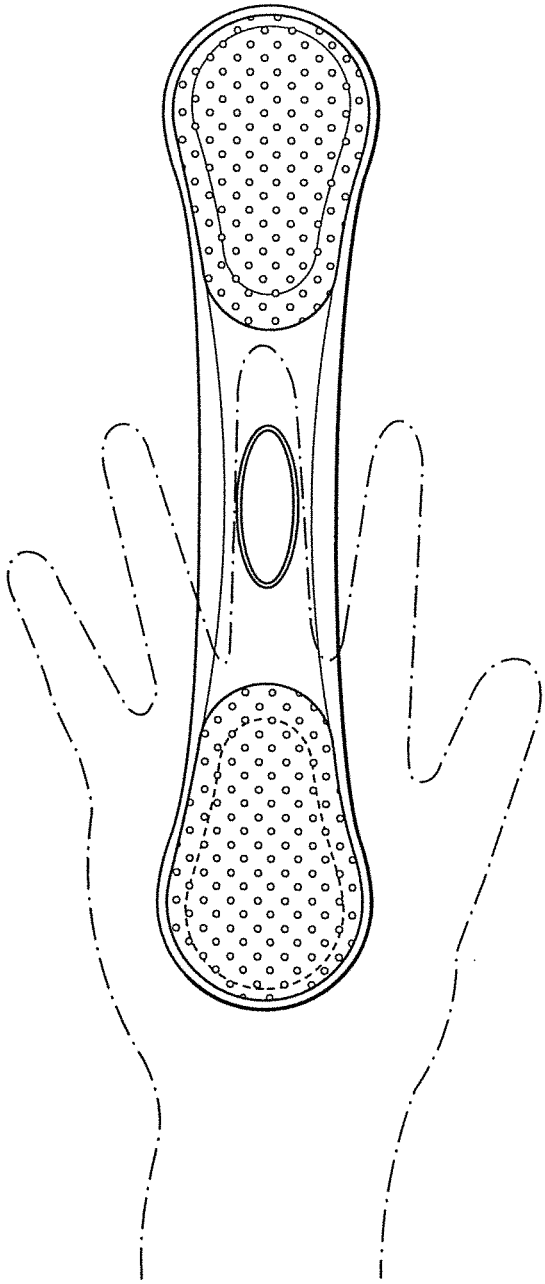
FIG. 13 shows the handle from the same view as FIG. 8 but with the outline of a human hand engaging with the handle.
Figure 14:
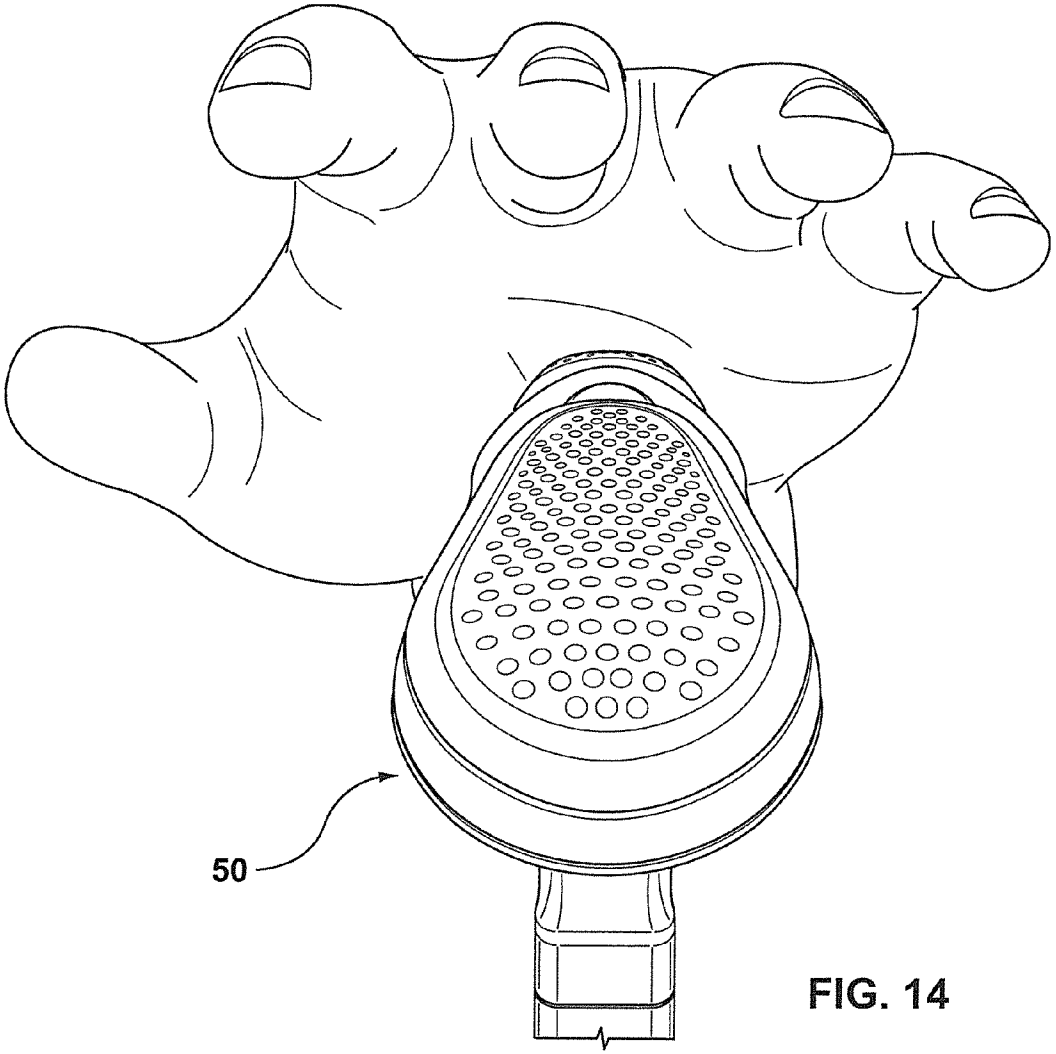
FIG. 14 shows a right view of the handle of FIG. 1 but with a human hand engaging with the handle.
Figure 15:
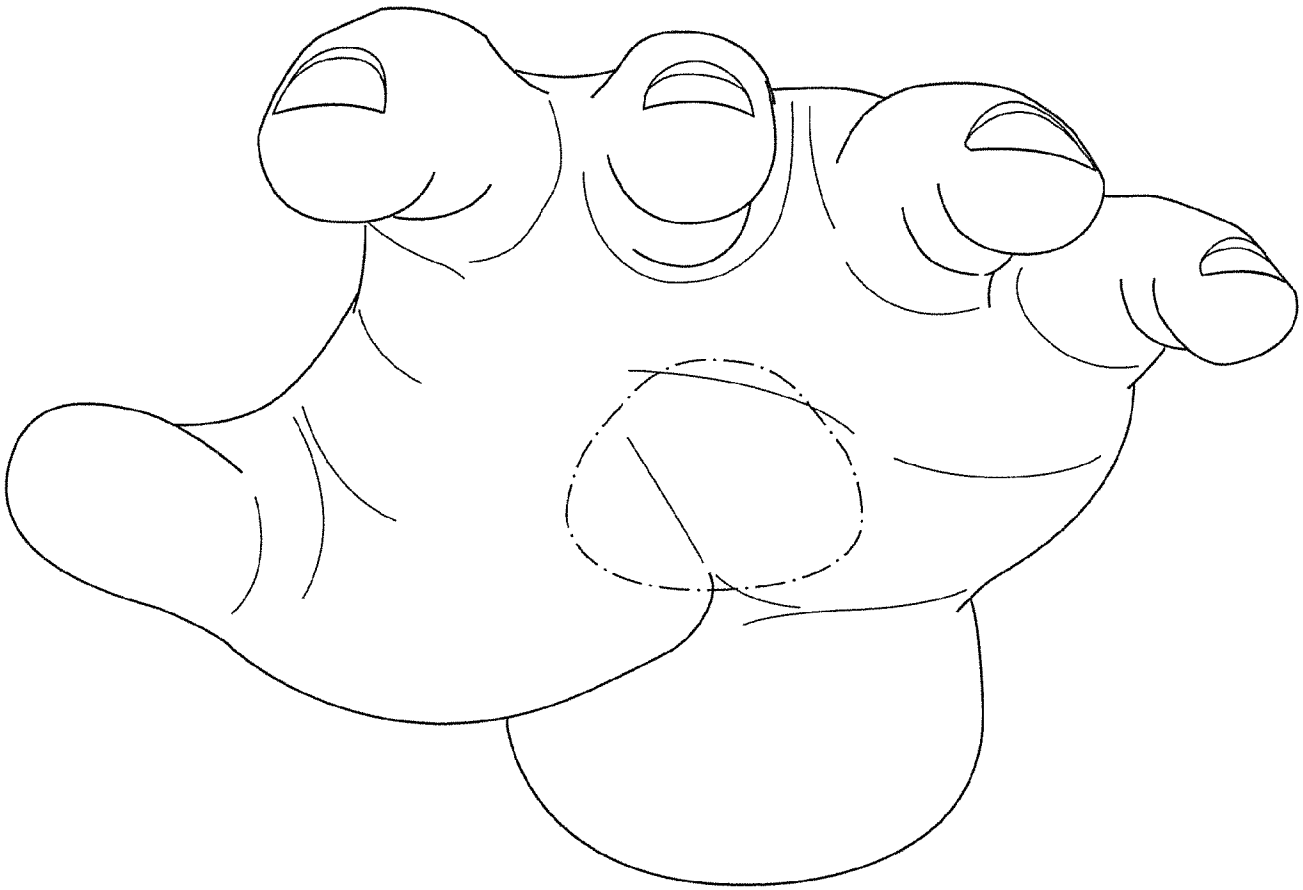
FIG. 15 shows the view of the human hand from FIG. 14 with a hashed-oval representing the area of contact between the handle and the palm.

FIG. 13, FIG. 14 and FIG. 15 shows the use of palm grips 108 in greater detail. FIG. 13 and FIG. 14 show example contact between the palm and a given palm grip 108. FIG. 15 shows an example of the area of contact by palm grip 108 on the palm. Of note is that the palm of a hand can contact substantially the entire surface of a palm grip 108. Also as noted is that, particularly when rods 66 are in the extended position shown in FIG. 1 and FIG. 2, the wrist can be angled comfortably while still contacting the surface of palm grip 108 and for pushing luggage 50.

Figure 16:
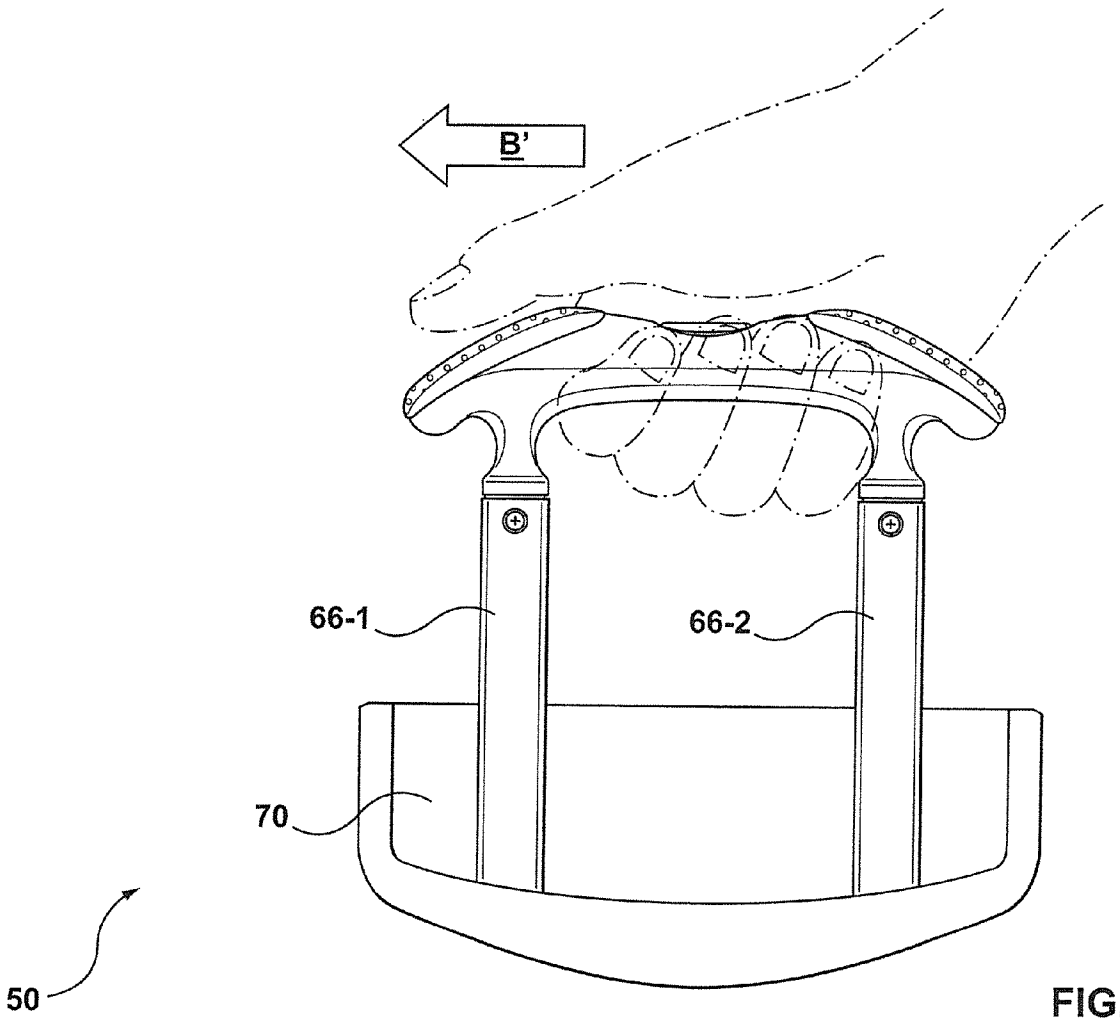
FIG. 16 shows the handle from the view of FIG. 3 with a human hand grasping the handle and pushing the handle in a first direction.
Figure 17:
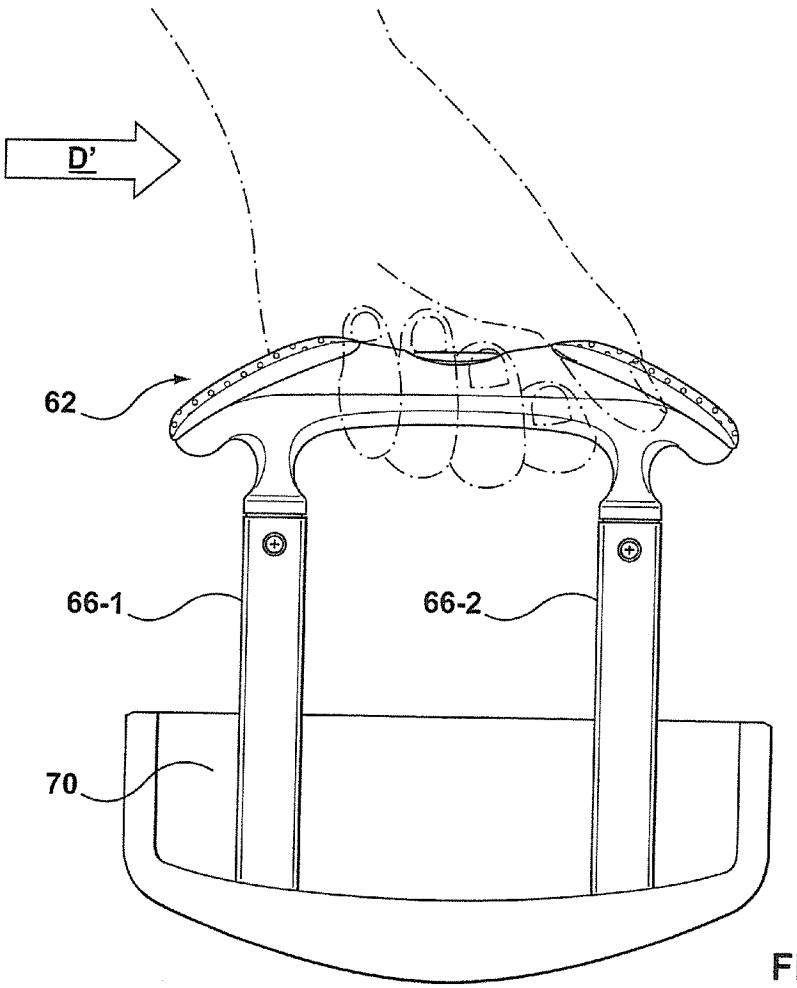
FIG. 17 shows the handle from the view of FIG. 16 with a human hand grasping the handle and pushing the handle in a second direction opposite from the direction in FIG. 16.

FIG. 16 and FIG. 17 show example use of central grip 112. The example in FIG. 16 and FIG. 17 contemplate the positioning of rods 66 at an intermediate position, lower than the extended position shown in FIG. 1 and FIG. 2, but higher than the retracted position. FIG. 16 and FIG. 17 demonstrate that central grip 112 may be comfortably grasped. FIG. 16 illustrates that palm grip 108-1 additionally provides a comfortable thumb rest and palm grip 108-2 providing padding for a portion of the palm. In FIG. 16, a force in the direction of arrow B' can be applied while walking to roll luggage 50. The direction in FIG. 16 is roughly analogous to the direction of movement shown in FIG. 1. In FIG. 17, a force in the direction of arrow D' can be applied while walking to roll luggage 50. The direction in FIG. 17 is roughly analogous to the direction of movement shown in FIG. 2.

Figure 18:
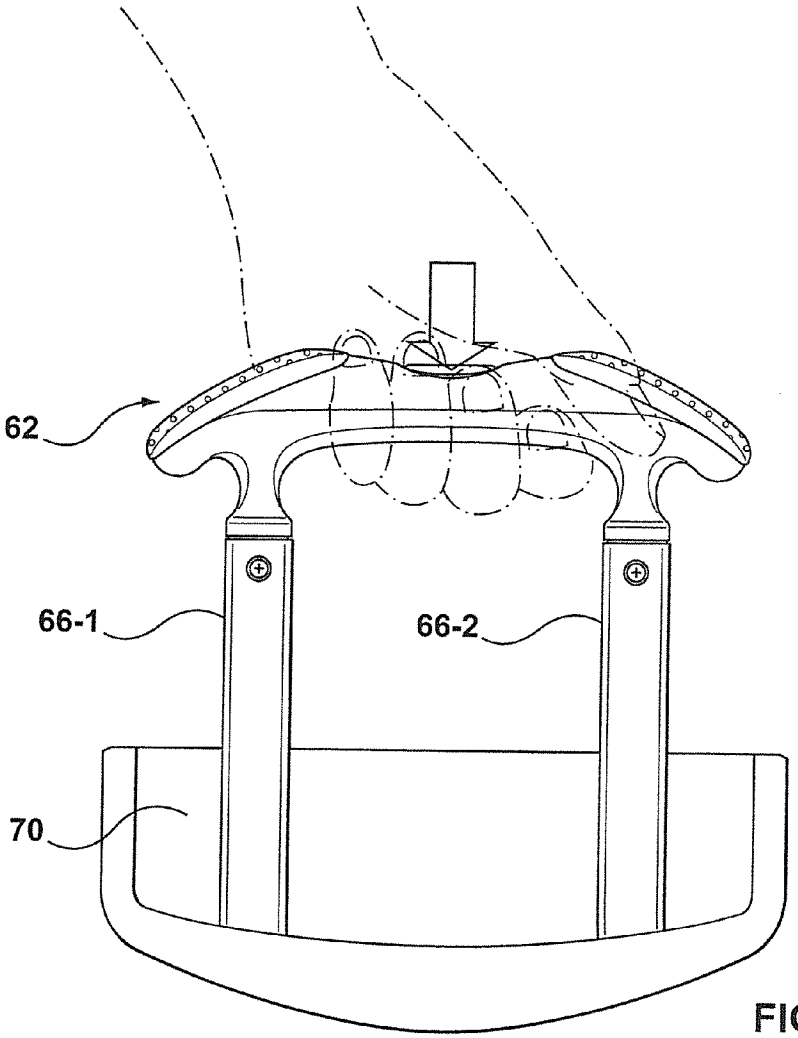
FIG. 18 shows the handle from the view of FIG. 18 with a human hand grasping the handle and depressing an actuator button on the handle.
Figure 19:
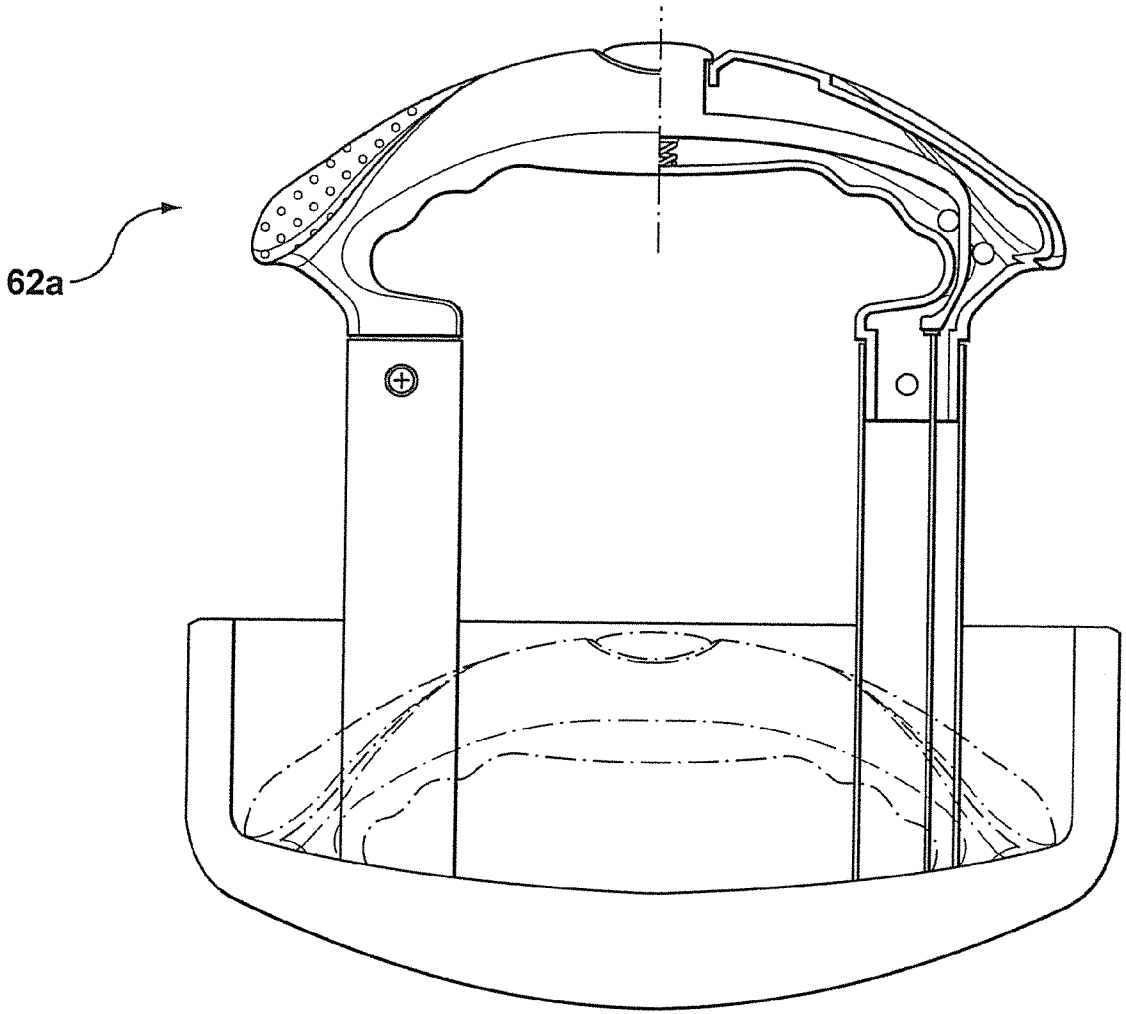
FIG. 19 is a front planar view of a first alternative configuration of the handle of FIG. 1.
Figure 20:
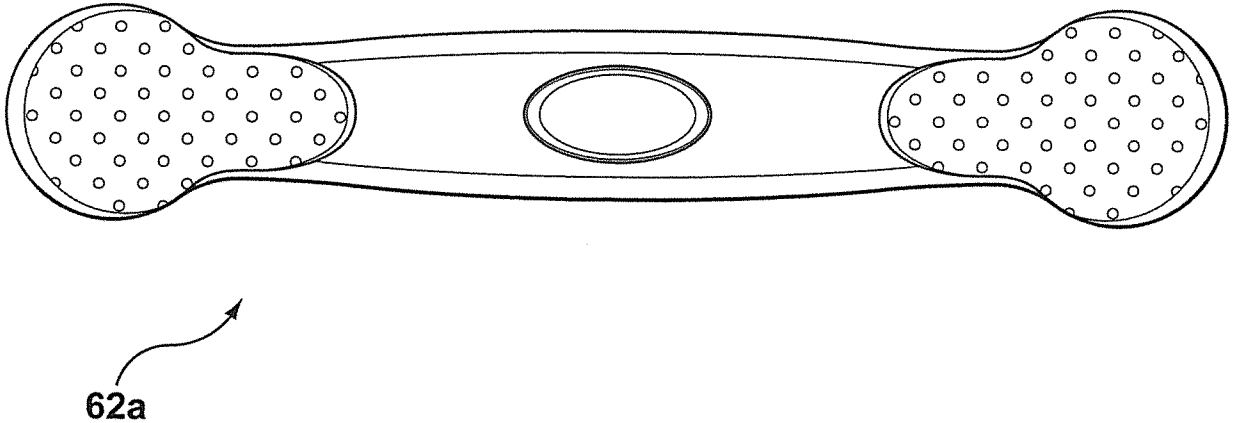
FIG. 20 is a top view of the handle of FIG. 19.
Figure 21:
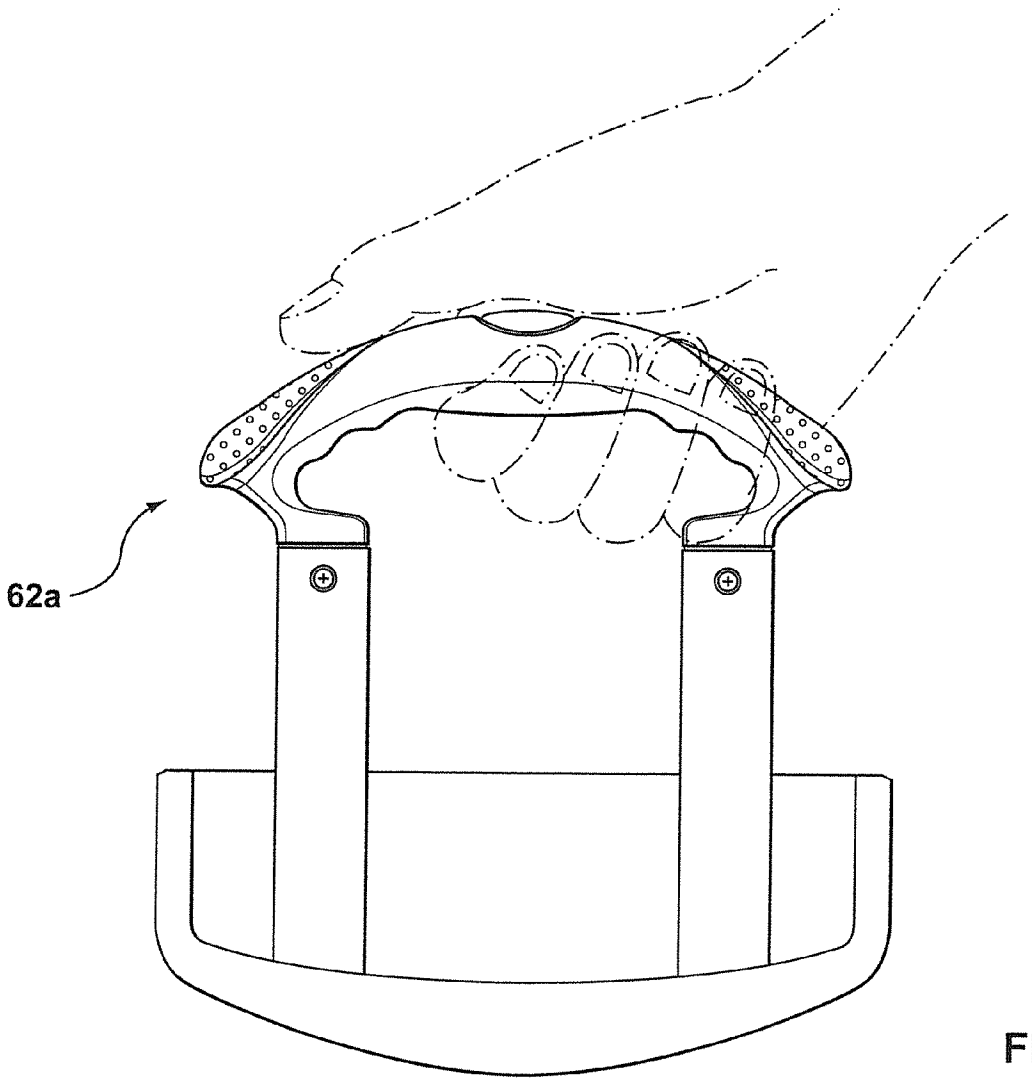
FIG. 21 shows the handle of FIG. 19 with a human hand grasping the handle and pushing the handle.
Figure 22:
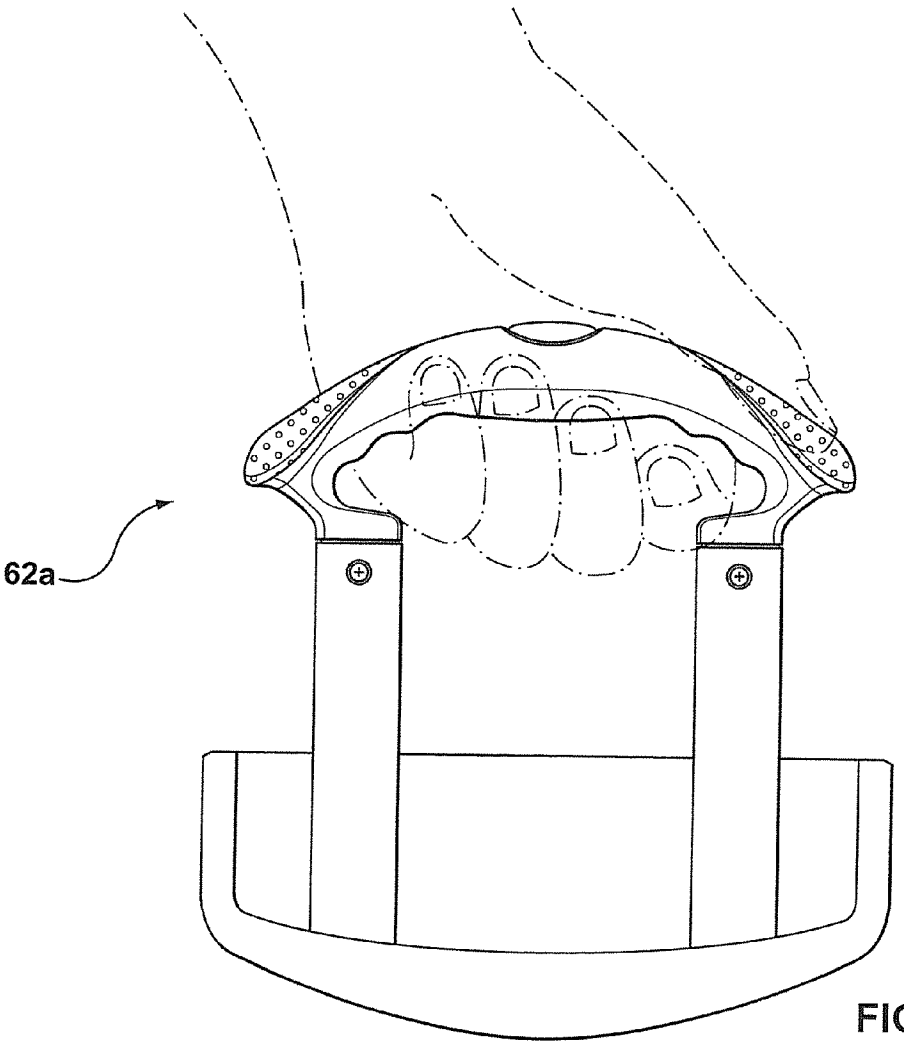
FIG. 22 shows the handle of FIG. 21 with a human hand grasping the handle and depressing the actuator button on the handle.
Figure 23:
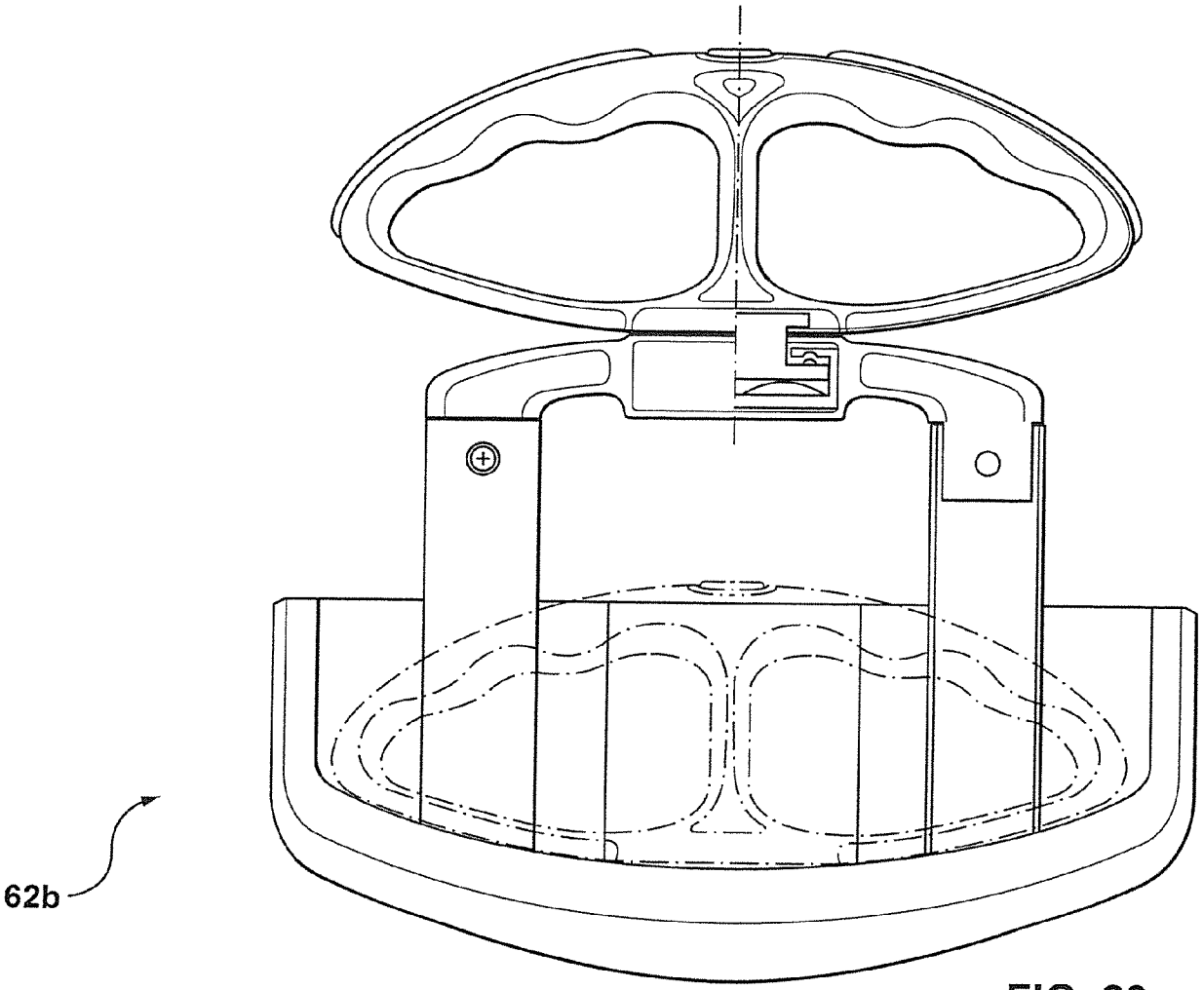
FIG. 23 is a front planar view of a second alternative configuration of the handle of FIG. 1.
Figure 24:
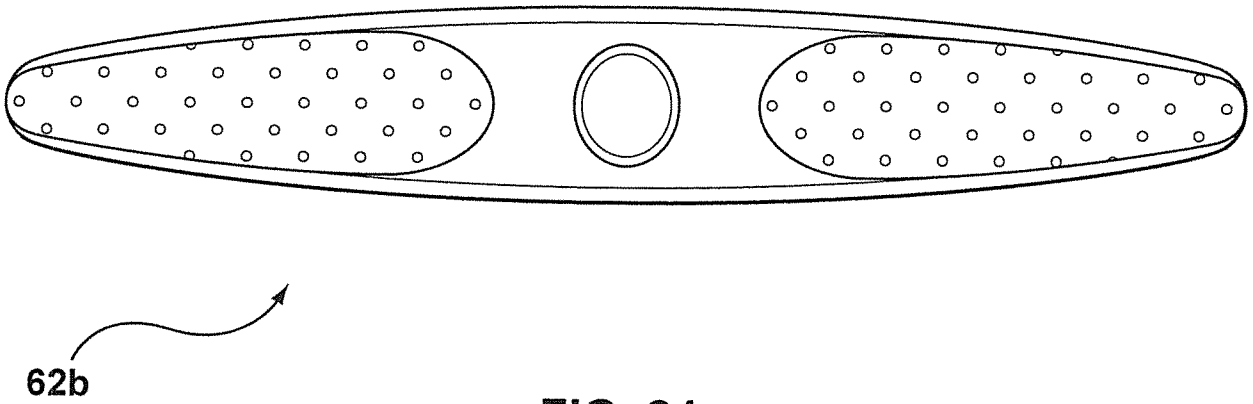
FIG. 24 is a top view of the handle of FIG. 23.

FIG. 18 shows further example use of central grip 112, whereby central grip is squeezed to accomplish depression of actuator 116 to unlock rods 66 and facilitate their movement between the extended position or the retracted position. While not shown, the grasping of handle 62 in FIG. 18 can also be used to apply a lifting or pulling force on handle 62.

Variations, subsets, enhancements and combinations of the foregoing are contemplated. For example, FIG. 19, FIG. 20, FIG. 21, and FIG. 22 show a first alternative handle 62*a*, which is a variation on handle 62. Handle 62*a* has slightly different shape but includes palm grips 108, while omitting the concavity of central grip 112.

Figure 25:
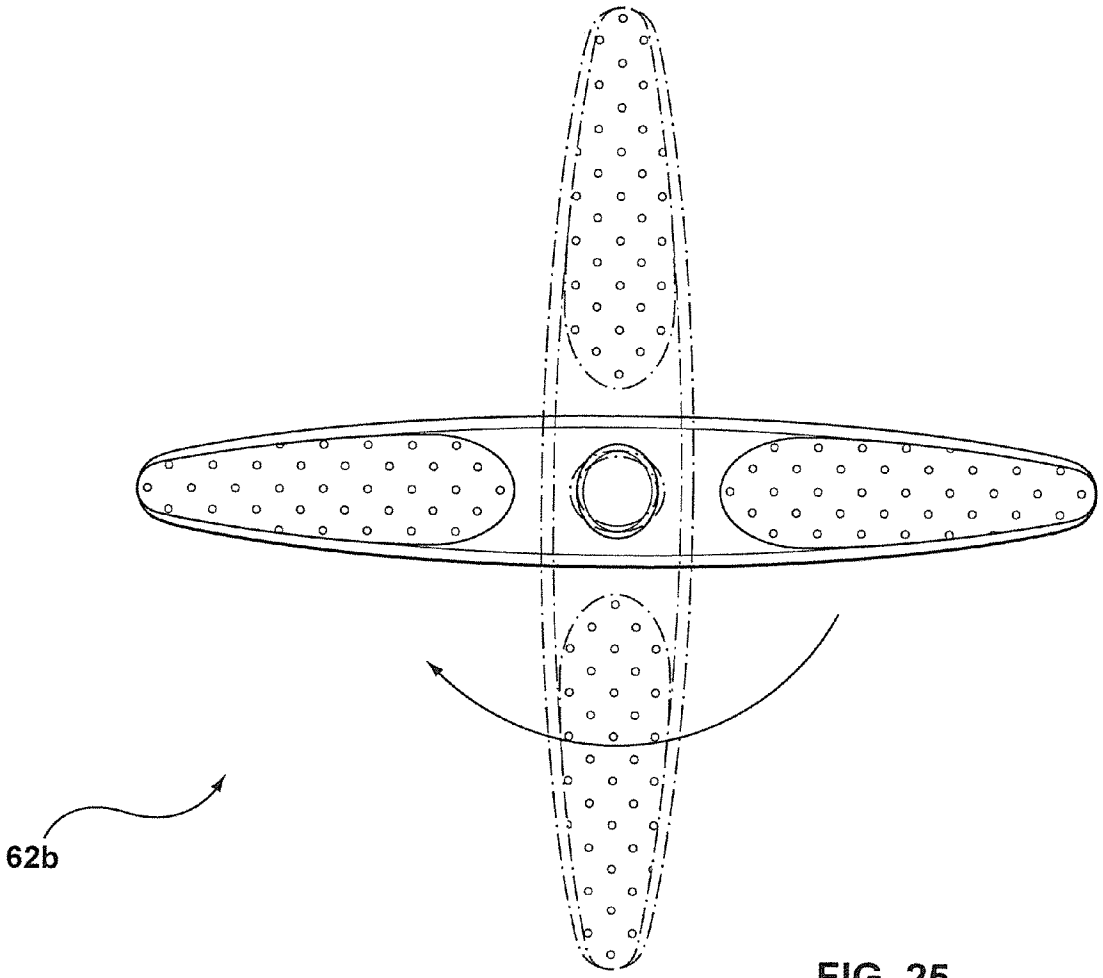
FIG. 25 shows the top view of the handle of FIG. 24 including angles of possible rotation.
Figure 26:
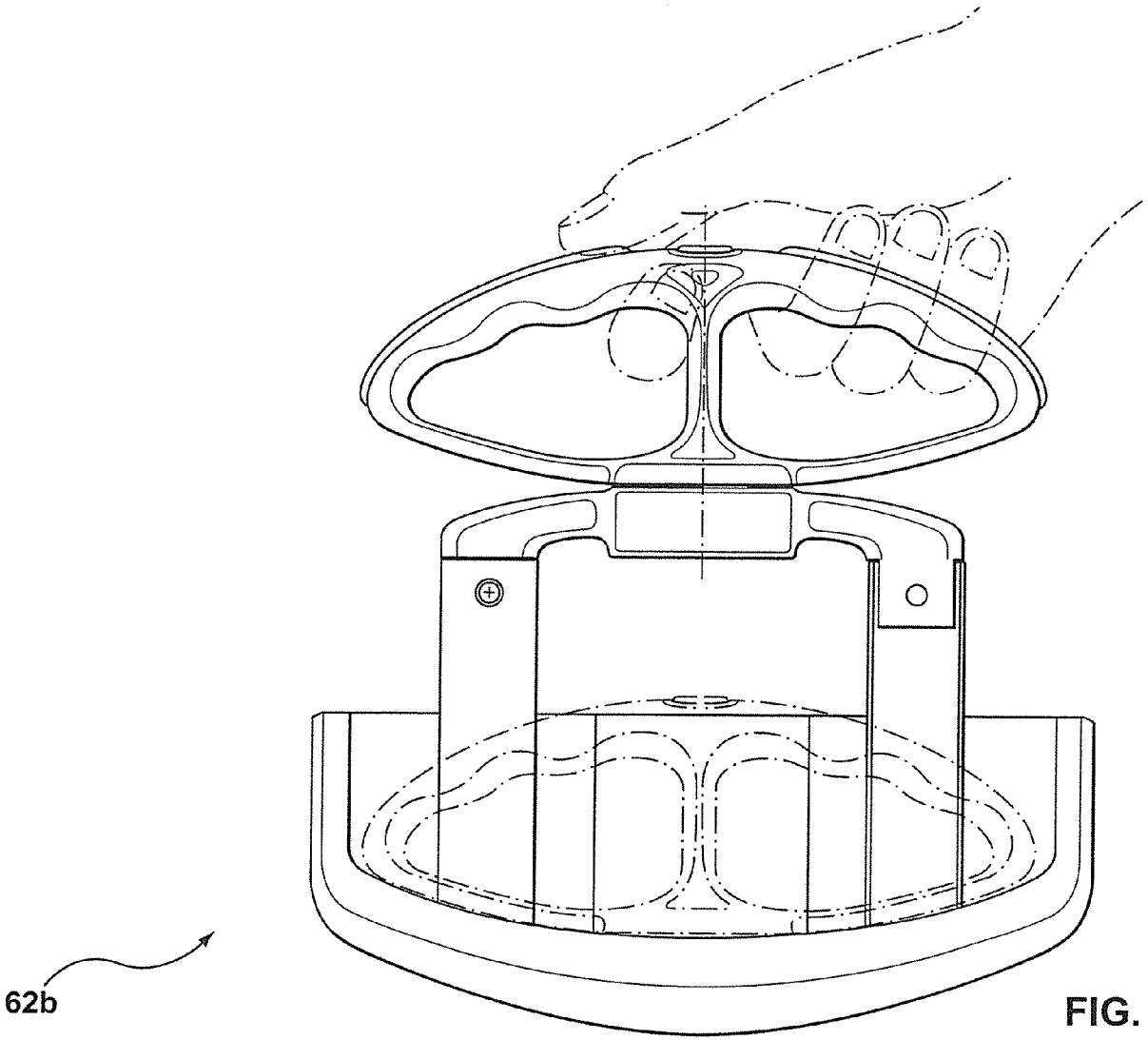
FIG. 26 shows the handle of FIG. 25 with a human hand grasping the handle.
Figure 27:
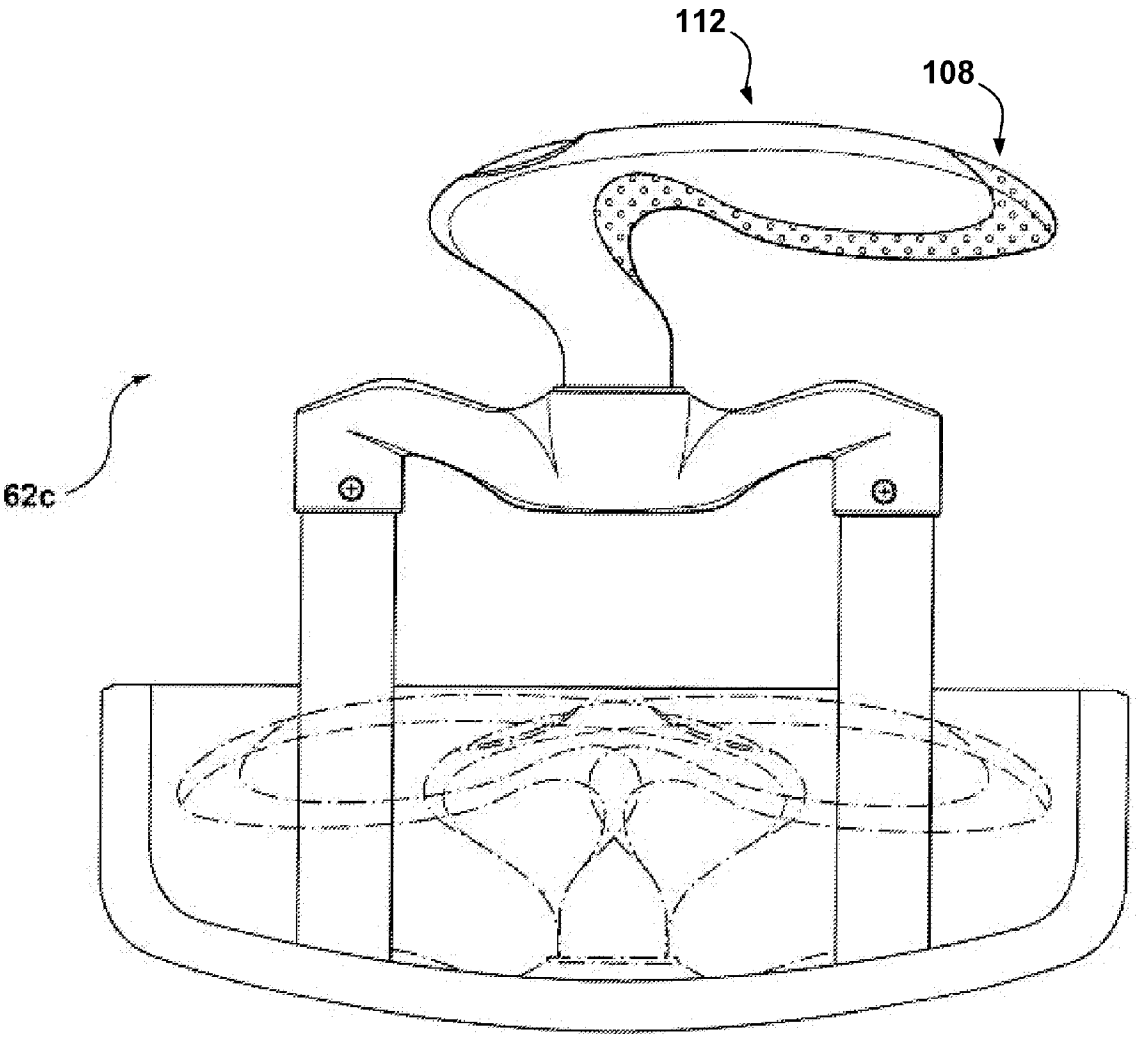
FIG. 27 is a front planar view of a third alternative configuration of the handle of FIG. 1.
Figure 28:
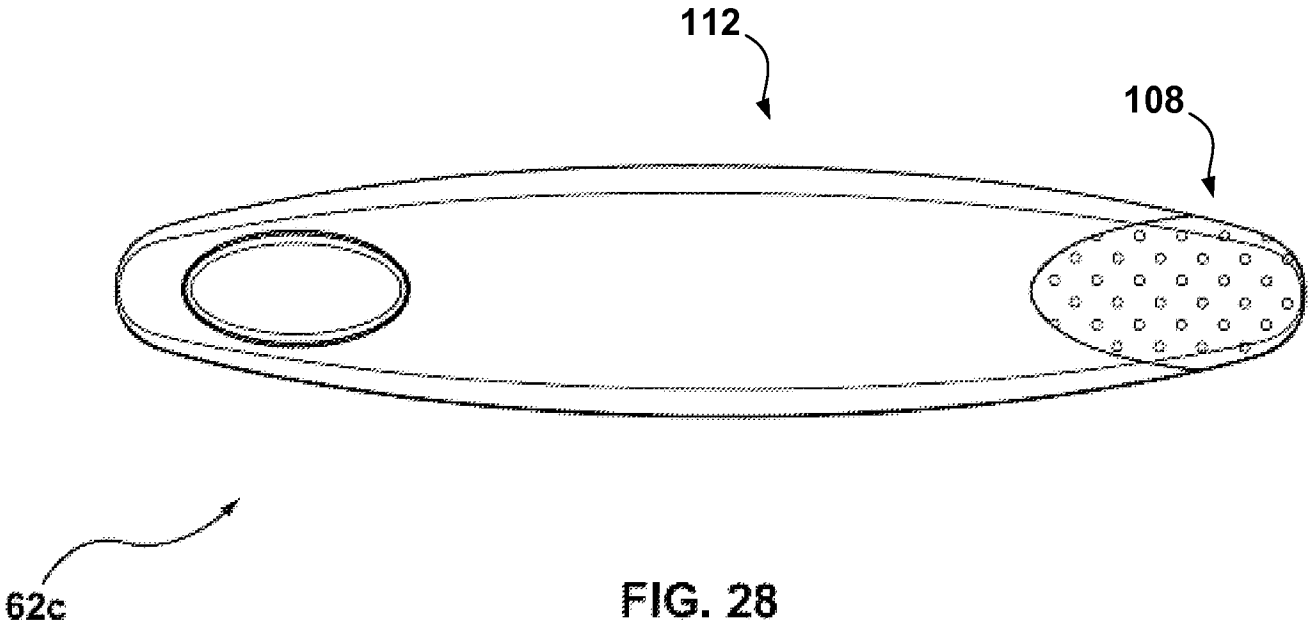
FIG. 28 is a top view of the handle of FIG. 27.

FIG. 23, FIG. 24, FIG. 25 and FIG. 26 show a second alternative handle 62*b*. Handle 62*b* also omits the concavity of central grip 112 and is rotatable, as shown in FIG. 25, by ninety degrees to provide a different grasping angle for the wrist.

Figure 29:
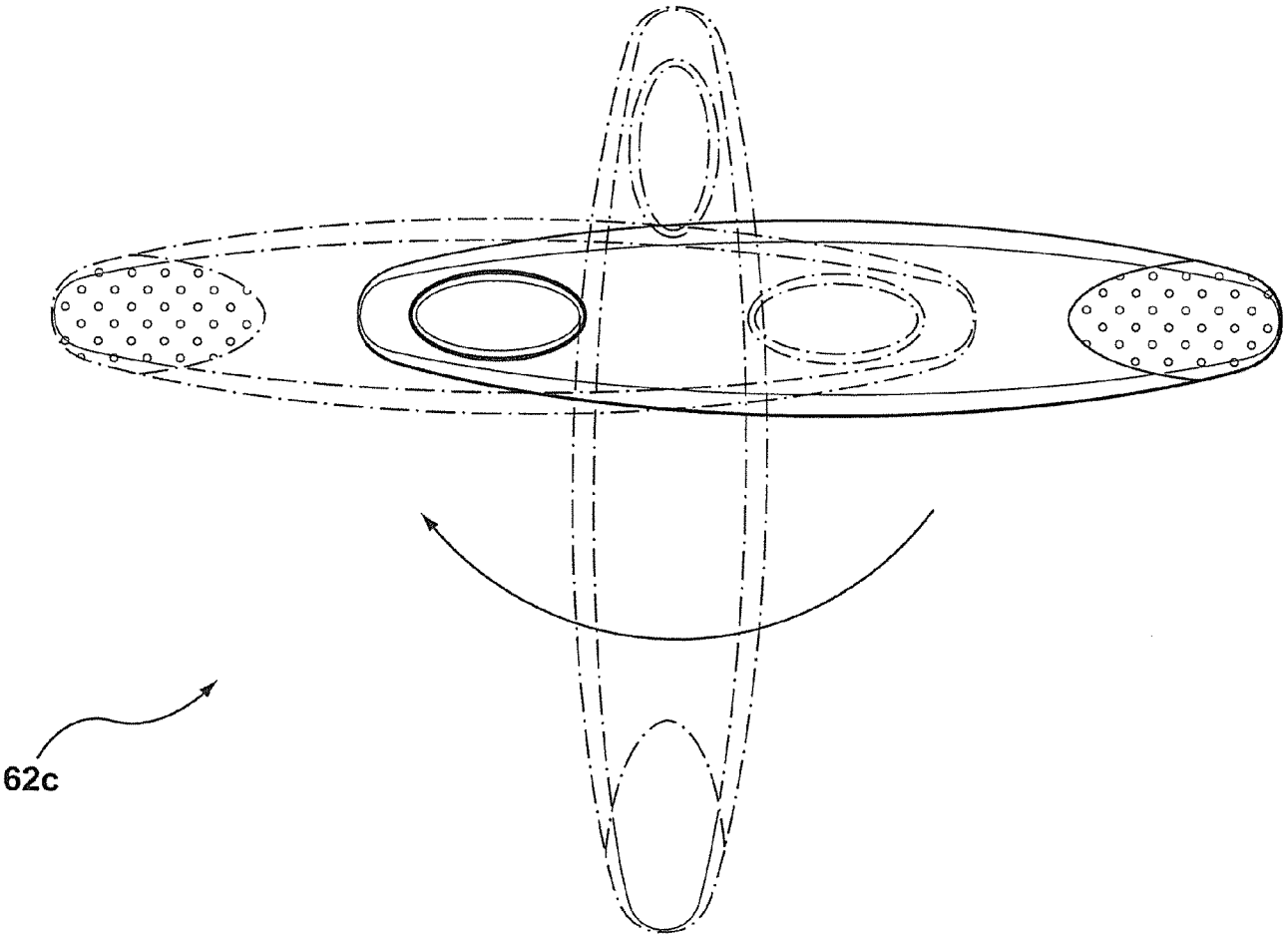
FIG. 29 shows the top view of the handle of FIG. 24 including angles of possible rotation.
Figure 30:
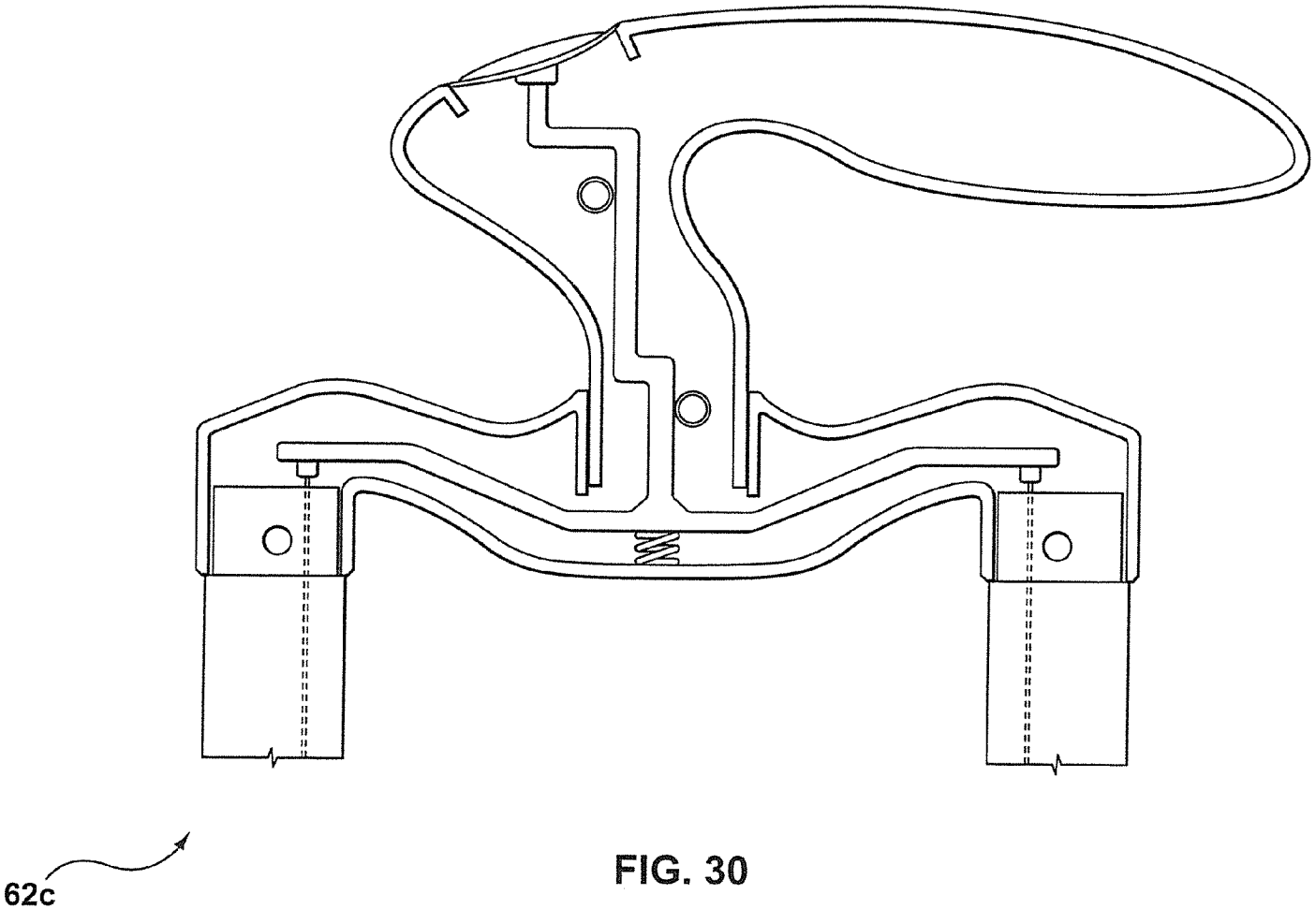
FIG. 30 is a front sectional view of the third alternative configuration showing the mechanical workings of the actuator.
Figure 31:
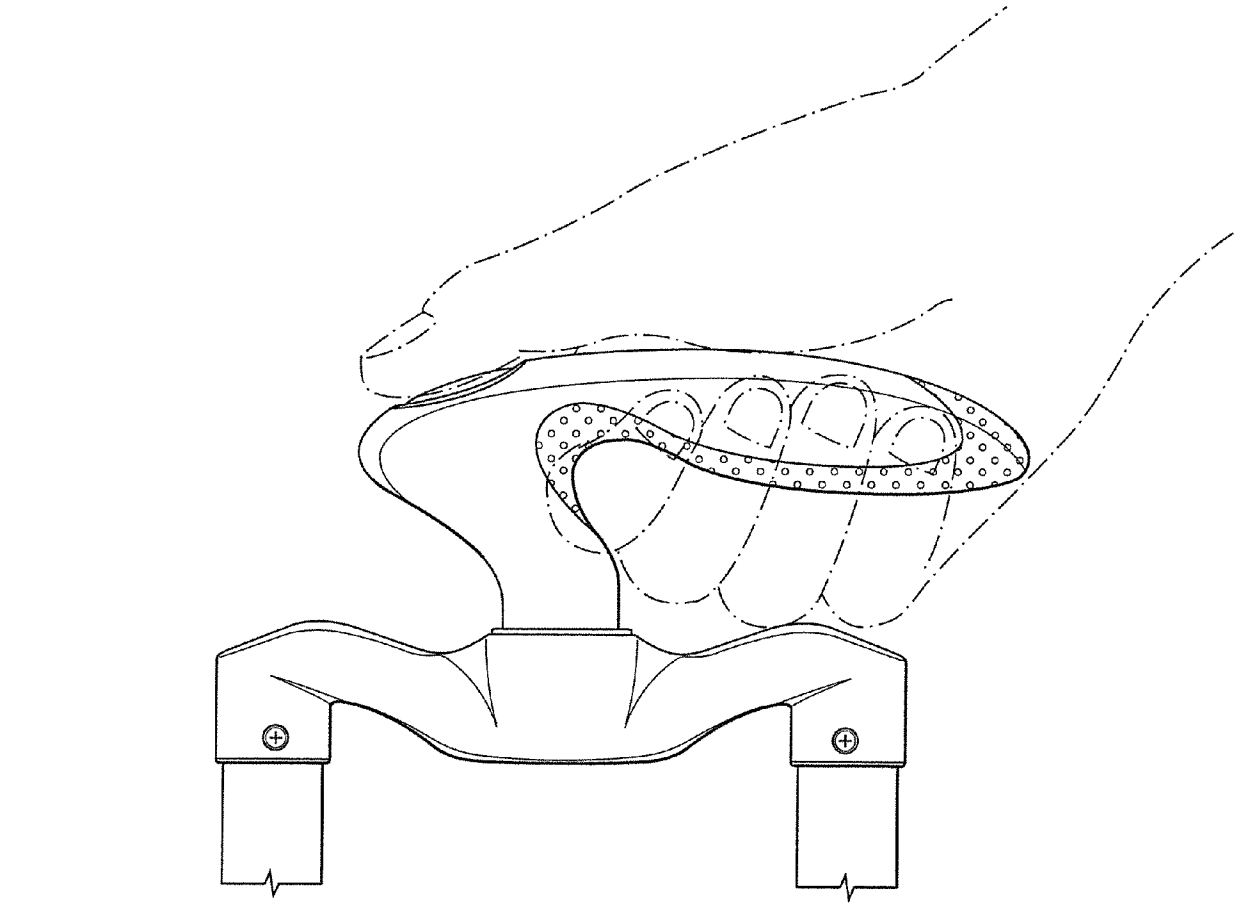
FIG. 31 shows the handle of FIG. 27 with a human hand grasping the handle.
Figure 32:
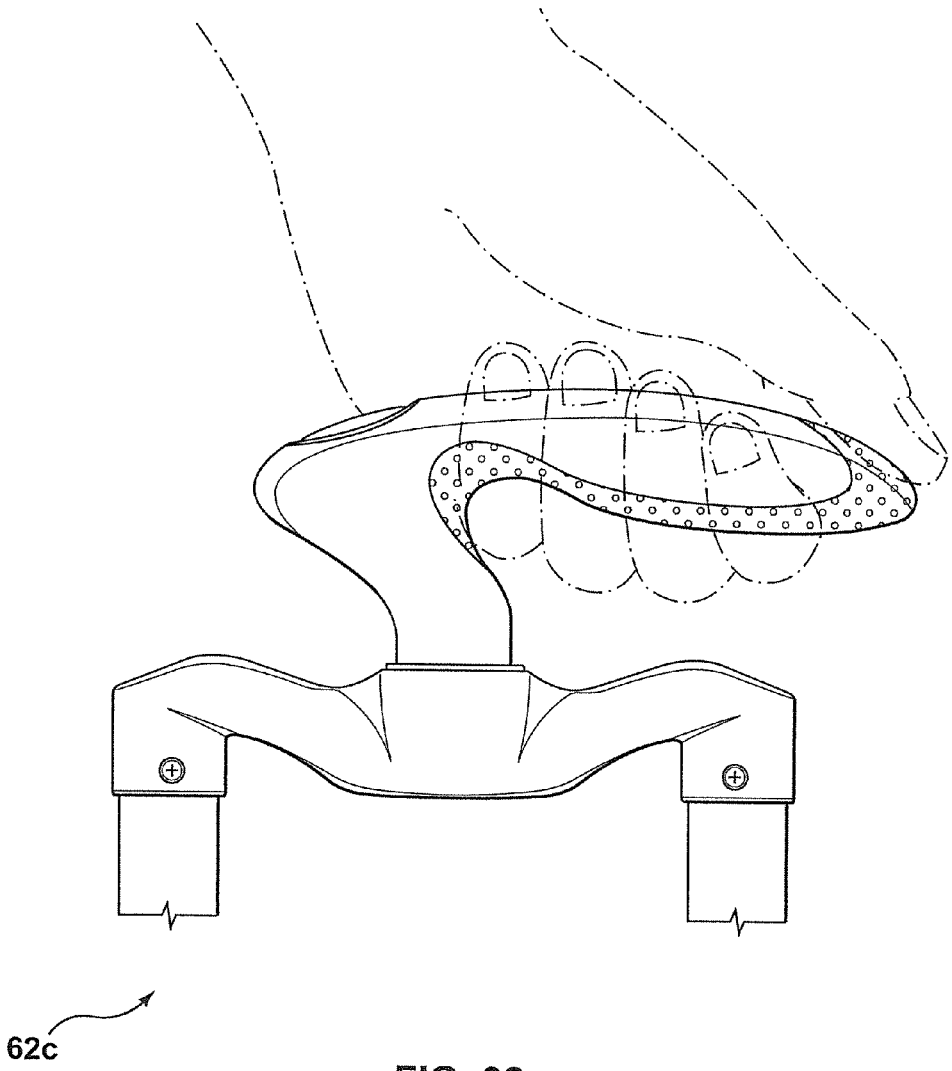
FIG. 32 shows an alternative grasping of the handle shown in FIG. 31.
Figure 33:
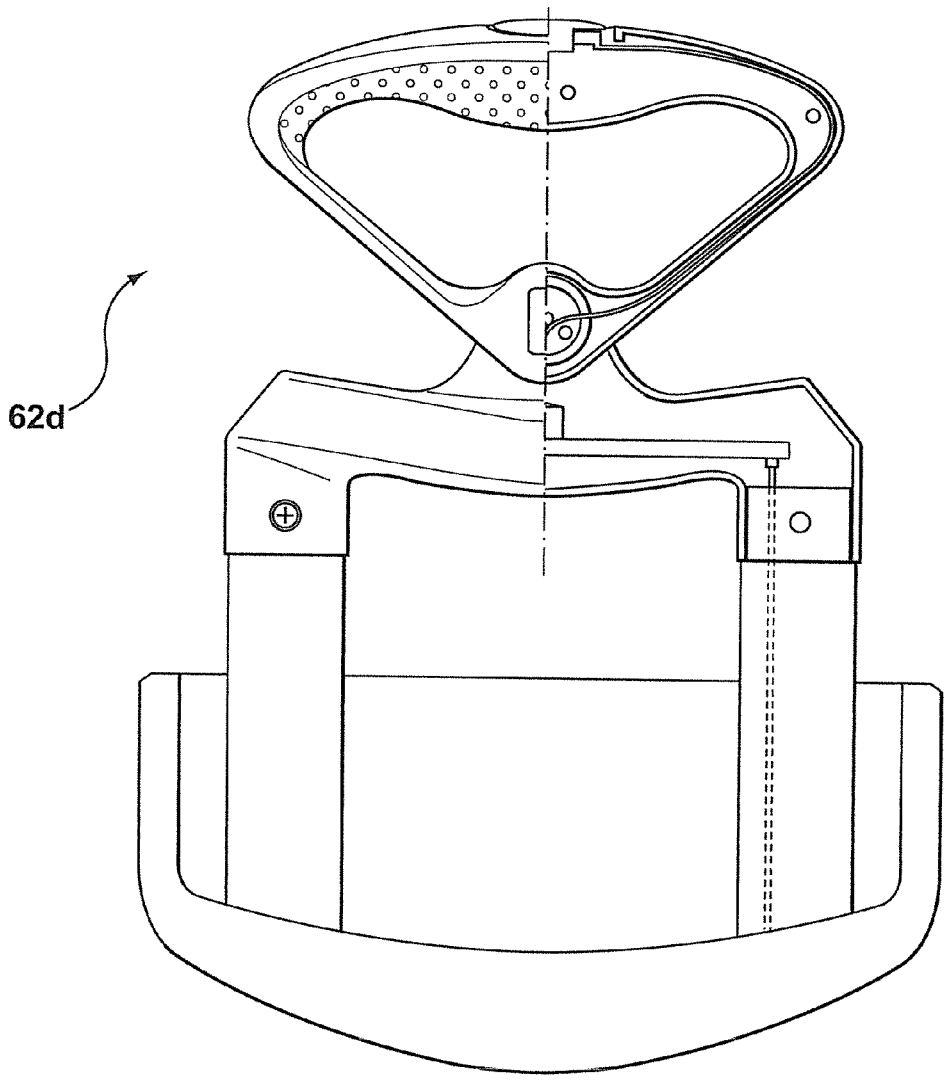
FIG. 33 is a front planar view of a fourth alternative configuration of the handle of FIG. 1.
Figure 34:
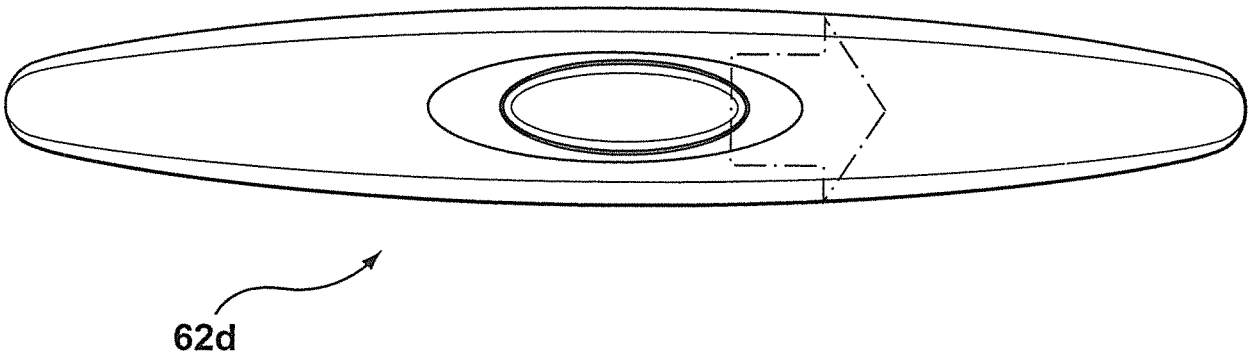
FIG. 34 shows the top view of the handle of FIG. 33.
Figure 35:
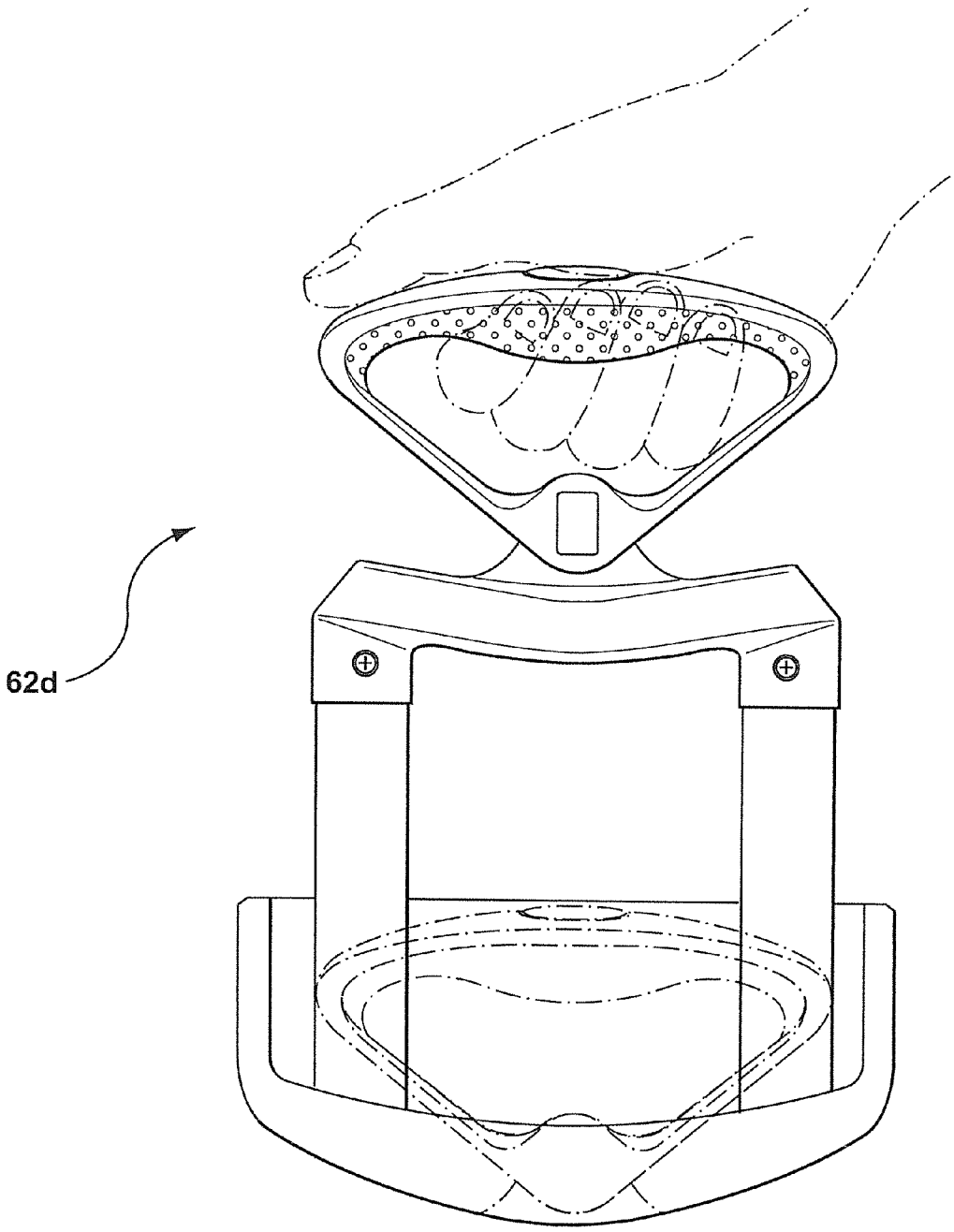
FIG. 35 shows the handle of FIG. 33 with a human hand grasping the handle.
Figure 36:
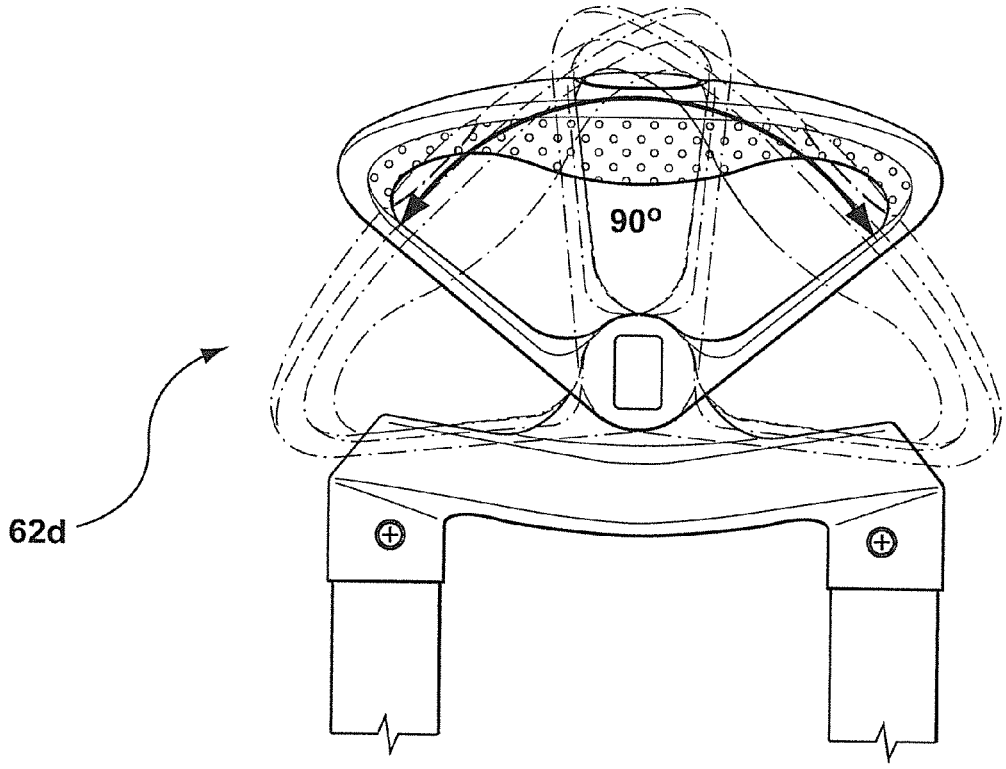
FIG. 36 shows the handle of FIG. 33 including angles of possible rotation.

FIG. 27, FIG. 28, FIG. 29, FIG. 30, FIG. 31 and FIG. 32 show a third alternative handle 62*c*. Like handle 62*b*, handle 62*c* is also rotatable, as shown in FIG. 29, by ninety degrees, and to a full one-hundred-and-eighty-degrees to provide a different grasping angles for the wrist.

FIG. 33, FIG. 34, FIG. 35 and FIG. 36 shows a fourth alternative handle 62*d*. Handle 62*d* is pivotable about an axis that is perpendicular to rods 66 to thereby provide different ergonomic angles for grasping.

In a still further variation, not shown, handle 62 may be implemented so as to have a partially spheroidal shape (i.e. akin to a section of a sphere) so that handle 62 can be pushed ergonomically from any direction.

The invention claimed is:

1. An article of luggage comprising:

a handle having a first end and a second end opposite the first end, the handle connectable to at least one rod, the at least one rod connecting the handle to a compartment, the at least one rod configured to position the handle relative to the compartment at a retracted position and an extended position;

a plurality of spinner wheels connected to the compartment, each of the spinner wheels being rotatable about an axis substantially normal to a rolling surface, the plurality of spinner wheels being the only wheels of the article of luggage and being configured to roll the article of luggage in any direction in response to force applied at the handle;

at least one palm contact surface disposed at least one end of the handle;

a central portion of the handle adjacent to the at least one palm contact surface for applying a pulling force;

the at least one palm contact surface angled at an obtuse angle with respect to the length of the handle for comfortable one-handed pushing by a palm of a hand from the at least one end of the handle when all the plurality of spinner wheels are in contact with the rolling surface, and the at least one palm contact surface configured to receive at least one applied pushing force from the palm.

2. The article of luggage of claim 1, wherein the at least one palm contact surface is curved downwards toward the at least one end of the handle.

3. The article of luggage of claim 1, wherein the at least one palm contact surface is visually distinct from the central portion so as to invite pushing by the palm.

4. The article of luggage of claim 1, wherein the central portion comprises an actuator for releasing the at least one rod to make the at least one rod movable between the extended position distal from the compartment and the retracted position proximal to the compartment.

5. The article of luggage of claim 1, wherein the at least one palm contact surface is at least in part convex.

6. The article of luggage of claim 1, wherein the at least one palm contact surface is at least in part tear-drop shaped.

7. The article of luggage of claim 1, wherein the at least one palm contact surface is textured, made of resiliently-deformable material, or textured and made of resiliently-deformable material.

8. The article of luggage of claim 1, wherein the at least one palm contact surface is affixed to the handle.

9. The article of luggage of claim 1, wherein the at least one palm contact surface is formed of a first material and the handle is formed of a second material that is different from the first material.

10. The article of luggage of claim 1, wherein the width of the handle is wider near the at least one palm contact surface than in the central portion.

11. The article of luggage of claim 1, wherein the at least one palm contact surface includes a frictional surface configured to increase a frictional force between the at least one palm contact surface and the palm.

12. The article of luggage of claim 11, wherein the frictional surface comprises a textured pattern.

13. The article of luggage of claim 11, wherein the frictional surface comprises a resiliently-deformable material, the resiliently-deformable material configured to improve distribution of force across the portion of the palm that comes into contact with the at least one palm contact surface.

14. The article of luggage of claim 1, wherein the at least one palm contact surface is configured to receive the applied pushing force from the palm of the hand in a direction substantially parallel the length of the handle while walking to roll the article of luggage.

15. The article of luggage of claim 1, wherein the at least one palm contact surface is at least in part convex, the at least one palm contact surface is curved downwards toward the at least one end of the handle, and the width of the handle is wider near the at least one palm contact surface than in the central portion.

16. A handle for an article of luggage, the handle comprising:

a body having a first end and a second end opposite the first end, the body connectable to at least one rod, the at least one rod for connecting the handle to a compartment of the article of luggage, the article of luggage having a plurality of spinner wheels connected to the compartment, the plurality of spinner wheels being the only wheels of the article of luggage, the at least one rod configured to position the handle relative to the compartment at a retracted position and an extended position;

a central portion of the body configured for applying a pulling force to the article of luggage;

at least one palm contact surface disposed at least one end of the handle and adjacent to the central portion;

the at least one palm contact surface angled at an obtuse angle with respect to the length of the handle for comfortable one-handed pushing by a palm of a hand from the at least one end of the handle when all the plurality of spinner wheels are in contact with the rolling surface, and the at least one palm contact surface shaped to complement the shape of a palm of a hand and configured to receive at least one applied pushing force from the palm to move the article of luggage.

17. The handle of claim 16, wherein the at least one palm contact surface is curved downwards toward the at least one end of the handle.

18. The handle of claim 16, wherein the at least one palm contact surface is visually distinct from the central portion so as to invite pushing by the palm.

19. The handle of claim 16, wherein the at least one palm contact surface is at least in part convex.

20. The handle of claim 16, wherein the at least one palm contact surface is at least in part tear-drop shaped.

21. The handle of claim 16, wherein the at least one palm contact surface is textured.

22. The handle of claim 16, wherein the at least one palm contact surface is made of resiliently-deformable material.

23. The handle of claim 16, wherein the at least one palm contact surface is formed of a first material and the handle is formed of a second material that is different from the first material.

24. The handle of claim 16, wherein the width of the handle is wider near the at least one palm contact surface than in the central portion.

25. The handle of claim 16, wherein the at least one palm contact surface includes a frictional surface configured to increase a frictional force between the at least one palm contact surface and the palm.

26. The handle of claim 25, wherein the frictional surface comprises a textured pattern.

27. The handle of claim 25, wherein the frictional surface comprises a resiliently-deformable material, the resiliently-deformable material configured to improve distribution of force across the portion of the palm that comes into contact with the at least one palm contact surface.

28. An article of luggage comprising:

a handle having a first end and a second end opposite the first end;

two rods connecting the handle to a compartment, the two rods having a retracted position, an extended position, and at least one intermediate position between the retracted position and the extended position;

four spinner wheels connected to the compartment, each of the spinner wheels being rotatable about an axis substantially normal to a rolling surface, the four spinner wheels being the only wheels connected to the compartment and being configured to roll the article of luggage in any direction in response to force applied to the handle;

two palm contact surfaces, one disposed at each end of the handle;

each palm contact surface being rounded; and each palm contact surface being angled at an obtuse angle measured from a plane parallel to the length of the handle so that when a palm of a hand is placed on the palm contact surface with the hand positioned along the length of the handle, the wrist is angled comfortably for comfortable one-handed pushing of the article of luggage from the respective end of the handle when all the spinner wheels are in contact with the rolling surface; and a central portion of the handle located between the two palm contact surfaces for applying a pulling force, wherein the central portion of the handle is different from the two palm contact surfaces in at least one of texture or material.

29. The article of luggage of claim 28 wherein the width of the handle near each palm contact surface is wider than in the central portion.

* * * * *